US009709264B2

(12) United States Patent
Yu

(10) Patent No.: US 9,709,264 B2
(45) Date of Patent: Jul. 18, 2017

(54) DUAL VENTURI FOR WATER HEATER

(71) Applicant: KYUNGDONG NAVIEN CO., LTD., Pyeongtaek-si (KR)

(72) Inventor: Jeong Gi Yu, Gwangmyeong-si (KR)

(73) Assignee: KYUNGDONG NAVIEN CO., LTD., Pyeongtaek-si, Gyeonggi-do (KR)

( * ) Notice: Subject to any disclaimer, the term of this patent is extended or adjusted under 35 U.S.C. 154(b) by 427 days.

(21) Appl. No.: 14/381,592

(22) PCT Filed: Jan. 21, 2013

(86) PCT No.: PCT/KR2013/000472
§ 371 (c)(1),
(2) Date: Aug. 27, 2014

(87) PCT Pub. No.: WO2013/129775
PCT Pub. Date: Sep. 6, 2013

(65) Prior Publication Data

US 2015/0064636 A1 Mar. 5, 2015

(30) Foreign Application Priority Data

Feb. 28, 2012 (KR) ..... 10-2012-0020640

(51) Int. Cl.
*F23D 14/62* (2006.01)
*F23D 14/08* (2006.01)
(Continued)

(52) U.S. Cl.
CPC ..... *F23D 14/08* (2013.01); *F23D 14/60* (2013.01); *F23D 14/62* (2013.01); *F23L 3/00* (2013.01);
(Continued)

(58) Field of Classification Search
CPC ..... F23D 14/62; F23D 14/60; F23D 14/64; F23L 3/00; F02D 19/0673; B01F 5/0418;
(Continued)

(56) References Cited

U.S. PATENT DOCUMENTS 4,087,045 A * 5/1978 Matthews ..... F23N 1/065 110/163
4,408,581 A * 10/1983 Pfalzgraf ..... F02D 9/102 123/337
(Continued)

FOREIGN PATENT DOCUMENTS

| | | | |
|---|---|---|---|
| JP | 08-296812 | A | 11/1996 |
| KR | 2002-0033858 | A | 5/2002 |
| KR | 20-0387916 | Y1 | 6/2005 |

OTHER PUBLICATIONS

International Search Report mailed Apr. 12, 2013 for International Application No. PCT/KR2013/000472.
(Continued)

*Primary Examiner* — Jason Lau
(74) *Attorney, Agent, or Firm* — Novick, Kim & Lee, PLLC; Jae Youn Kim

(57) ABSTRACT

Provided is a dual venturi having: a tubular part; a body part, for opening/closing the flow of secondary air by rotating in the horizontal plane and vertical plane directions, the horizontal plane direction being the cross-sectional direction of the tubular part and the vertical plane direction being perpendicular to the horizontal plane; a central passageway, becoming the passageway for primary air; a damper part, and a damper part-side secondary gas outlet; a driving part, for rotationally driving the damper part in the horizontal and vertical planes; a gas inlet-side primary gas outlet connected openly to the damper part-side primary gas outlet; and a gas inlet for introducing gas into the tubular part via the damper part, which openly connects selectively to the damper part-
(Continued)

side secondary gas outlet on the basis of the rotational position of the damper part, and for forming the rotational shaft of the damper part along with the rotational shaft of the driving part.

9 Claims, 22 Drawing Sheets

(51) Int. Cl.
*F23D 14/60* (2006.01)
*F23L 3/00* (2006.01)
*F23N 3/06* (2006.01)
*F24H 9/20* (2006.01)

(52) U.S. Cl.
CPC ..... *F23N 3/06* (2013.01); *F23D 2203/007* (2013.01); *F23D 2900/00003* (2013.01); *F24H 9/2035* (2013.01)

(58) Field of Classification Search
CPC ..... B01F 15/026; B01F 2005/0435; B01F 3/0446; B01F 5/0426; B01F 5/043; B01F 5/0413; B01F 13/002; B01F 13/0033; B01F 5/0415; F02M 21/047
See application file for complete search history.

(56) References Cited

U.S. PATENT DOCUMENTS 4,448,578 A * 5/1984 Brunet ..... F27B 9/28 266/103
4,572,809 A * 2/1986 Bothwell ..... F02D 9/101 261/44.2
5,979,401 A * 11/1999 Hickey ..... F02B 31/00 123/306
7,665,987 B2 2/2010 Leclerc et al.
2011/0139045 A1 6/2011 Zatti et al.
2011/0168267 A1* 7/2011 Burnham ..... B01F 5/0413 137/1
2011/0220074 A1* 9/2011 Veerathappa ..... F02B 25/16 123/65 P

OTHER PUBLICATIONS

English Abstract for KR 2002-0033858 A.
English Abstract for JP 08-296812 A.

* cited by examiner

DUAL VENTURI FOR WATER HEATER

TECHNICAL FIELD

The present invention relates to a dual venturi for a water heater providing two steps for fluid supply level, and particularly to a dual venturi for a water heater providing air and gas supply levels in two steps in a gas water heater.

BACKGROUND OF THE INVENTION

In general, a gas water heater system is a heating apparatus providing living convenience, such as providing hot water for washing or taking a shower by heating low temperature direct water, and is not used for heating purposes. The system consists of two methods: instantaneous gas water heater system and storage gas water heater system.

The instantaneous gas water heater system of the above methods uses instantaneous heat exchanger to instantly heat desired amount of direct water for tapping hot water, and the storage gas water heater system consists of storing hot water in a storage tank and storing it while maintaining at a constant temperature for supplying.

The two aforementioned gas water heater systems comprise a heating means for heating low temperature direct water, and the heating means supplies a gas mixture mixed in a mixing valve to a burner, the gas mixture consisting of gas that is supplied through a gas regulator and air supplied through a blower.

PRIOR ART

Patent Literature (Patent Literature 1) Korean Patent Application No. 10-113502

The aforementioned patent literature is directed to a composite gas water heater system manufactured by combining the instantaneous gas water heater and storage gas water heater, thus manufacturing a gas water heater of a compact volume while at the same time allowing a stable use thereof by decreasing temperature difference of the cold water and the hot water.

In the aforementioned patent literature, air and gas is supplied to the burner (28) by passing gas, supplied through a gas regulator (22) which controls the amount of gas, through a nozzle (26) to release heat to the upper portion, as shown in FIG. 11. At this time, the blower (24) supplies air to the burner (28), thereby increasing combustion rate of the gas.

However, aforesaid gas water heater system is simply a structure in which air and gas are mixed to be supplied to a burner. It does not include a function of controlling the amount of air and gas according to the amount of heat quantity of the burner used for heating hot water needed by the user. Thus, hot water heater needs to be manufactured according to the heat quantity, which increases the manufacturing cost.

DISCLOSURE OF INVENTION

Technical Problem

The present invention has been made to solve the above-described problem occurring in the prior art, and an object of the present invention is to provide a dual venturi for a hot water heater with simplified structure to minimize the apparatus, high operational reliability, easy manufacturing process, and decreased manufacturing cost.

Technical Solution

The present invention, which aims to solve the above-described problem is directed to a dual venturi comprising, as a first configuration, a tubular part through which air and gas pass through; a body part, located in the interior of the tubular part, for opening/closing the flow of secondary air by rotating in the horizontal plane, that is in the cross-sectional direction to the tubular part, and the vertical plane that is perpendicular to the horizontal plane; a central passageway, formed in the center of the body part and having a smaller diameter than the diameter of the tubular part, becoming the passageway for primary air; a damper part having a damper part-side primary gas outlet for discharging primary gas and a damper part-side secondary gas outlet for discharging secondary gas; a driving part, connected to the lateral surface of the damper part via a rotational shaft, for rotationally driving the damper part in the horizontal and vertical planes; a gas inlet-side primary gas outlet connected to the damper part-side primary gas outlet; and a gas inlet for introducing gas into the tubular part via the damper part by means of the gas inlet-side secondary gas outlet, which connects selectively to the damper part-side secondary gas outlet and forms the rotational shaft of the damper part along with the rotational shaft of the driving part.

Preferably, the driving part comprises a synchronous motor, and the rotational shaft of the driving part is the rotational shaft of the synchronous motor.

Preferably, the gas inlet-side secondary gas outlet is connected to the damper part-side secondary gas outlet when the body part of the damper part is vertically positioned.

Preferably, the driving part includes a limit switch for indicating the horizontal plane and vertical plane positions of the damper part.

Preferably, the central passageway of the damper part is venturi shaped.

Preferably, the central diameter width of the tubular part increases from the center towards the upper and lower portions.

Preferably, the damper part-side primary gas outlet is formed in the central passageway.

Preferably, the damper part-side secondary gas outlet is formed on the outer surface such that it is facing the upper side of the tubular part when the body part is positioned in the horizontal plane.

Preferably, the damper part-side secondary gas outlet is formed on the outer surface such that it is facing both the upper side and the lower side of the tubular part when the body part is positioned in the horizontal plane.

Preferably, only one gas inlet-side secondary gas outlet is formed, which is connected to the damper part-side secondary gas outlet when the damper part is vertically positioned.

Preferably, two gas inlet-side secondary gas outlets are formed, which are connected to the damper part-side secondary gas outlet when the damper part is vertically positioned.

In order to realize the aforementioned objective, the second configuration of the present invention is directed to a dual venturi comprising, a tubular part through which air and gas pass through, having a primary gas inlet on the side thereof as a cylindrical duct; a body part, located in the interior of the tubular part, for opening/closing the flow of secondary air by rotating in the horizontal plane, that is in the cross-sectional direction to the tubular part, and the vertical plane direction that is perpendicular to the horizontal plane; a damper part having a damper part-side secondary gas outlet and a cutout part, which is partially removed space of the body part circumference, forming the primary air passageway in the direction of the tubular part passageway, via the passageway that is formed together with the inner surface circumference of the tubular part when the body part is positioned in the horizontal plane; a driving part, connected to the lateral surface of the damper part via a rotational shaft, for rotationally driving the damper part in the horizontal and vertical planes; and a secondary gas inlet for introducing secondary gas into the tubular part via the damper part by means of the secondary gas inlet-side outlet, which connects selectively to the damper part-side secondary gas outlet and forms the rotational shaft of the damper part along with the rotational shaft of the driving part.

Preferably, the primary gas inlet is positioned to face the cutout part when the body part is positioned in the horizontal plane direction.

Advantageous Effects

The following advantageous effects can be obtained through the present invention having the above configurations.

In the first embodiment,

First, the structure is simplified since the motor rotational shaft and the damper part are directly connected to rotate the damper part, an opening on one side of the cylindrical gas inlet is selected as the primary gas outlet, a slot-type opening is formed on the other side wall to form the secondary gas outlet, and the secondary gas outlet is opened/closed simultaneously with the opening/closing of the secondary air passageway via the rotation of the damper part.

Second, the motor rotational shaft and the cylindrical gas inlet are used as the rotational shaft of the damper part, thus, a separate rotational shaft does not need to be installed. Further, rotation of the damper part opens/closes the secondary gas outlet of the gas inlet that was stopped, thereby operational reliability is increased in addition to the simplicity of the structure.

Third, the tubular part forming the second-side air duct uses a commonly and widely used ventilation facilities, thus is easy to manufacture.

Fourth, additional elements such as a wire or a spring are not required since the damper part is directly connected to the rotational shaft of the motor of the driving part using the synchronous motor. Thus, the structure is even more simple and the overall volume is decreased.

Fifth, based on the first to fourth reasons above, simplification of the structure and decreased manufacturing costs can be achieved.

Regarding the second embodiment, apart from the advantageous effects of the first embodiment, a primary gas inlet is formed on one part of the lateral wall of the tubular part; the motor rotational shaft and the damper part are directly connected to rotate the damper part; and an opening on one side of the cylindrical secondary gas inlet is selected as the secondary gas outlet, such that the secondary gas outlet is opened/closed simultaneously with opening/closing of the secondary air passageway by the rotation of the damper part, thereby the structure is very simplified.

BRIEF DESCRIPTION OF THE DRAWINGS

FIG. 3*a* is a perspective view of the dual venturi, FIG. 3*b* is a planar sectional view of the dual venturi and FIG. 3*c* is a sectional view showing the positional relationship between the gas inlet and the secondary gas outlets of the damper part.

FIG. 4*a* is a perspective view of the dual venturi, FIG. 4*b* is a planar sectional view of the dual venturi and FIG. 4*c* is a sectional view showing the positional relationship between the gas inlet and the secondary gas outlets of the damper part.

FIG. 5*a* is a planar view of the limit switch and FIG. 5*b* is a lateral view of the limit switch.

FIG. 8*a* is a perspective view of the dual venturi, FIG. 8*b* is a planar sectional view of the dual venturi and FIG. 8*c* is a sectional view showing the positional relationship between the secondary gas inlet and the secondary gas outlets of the damper part.

FIG. 9*a* is a perspective view of the dual venturi, and FIG. 9*b* is a sectional view showing the positional relationship between the secondary gas inlet and the secondary gas outlets of the damper part.

FIG. 10*a* is a planar view of the limit switch and FIG. 10*b* is a lateral view of the limit switch.

DESCRIPTION OF THE PREFERRED EMBODIMENTS

Hereinafter, the first embodiment of the present invention will be described with reference to the accompanying drawings.

Figure 1:
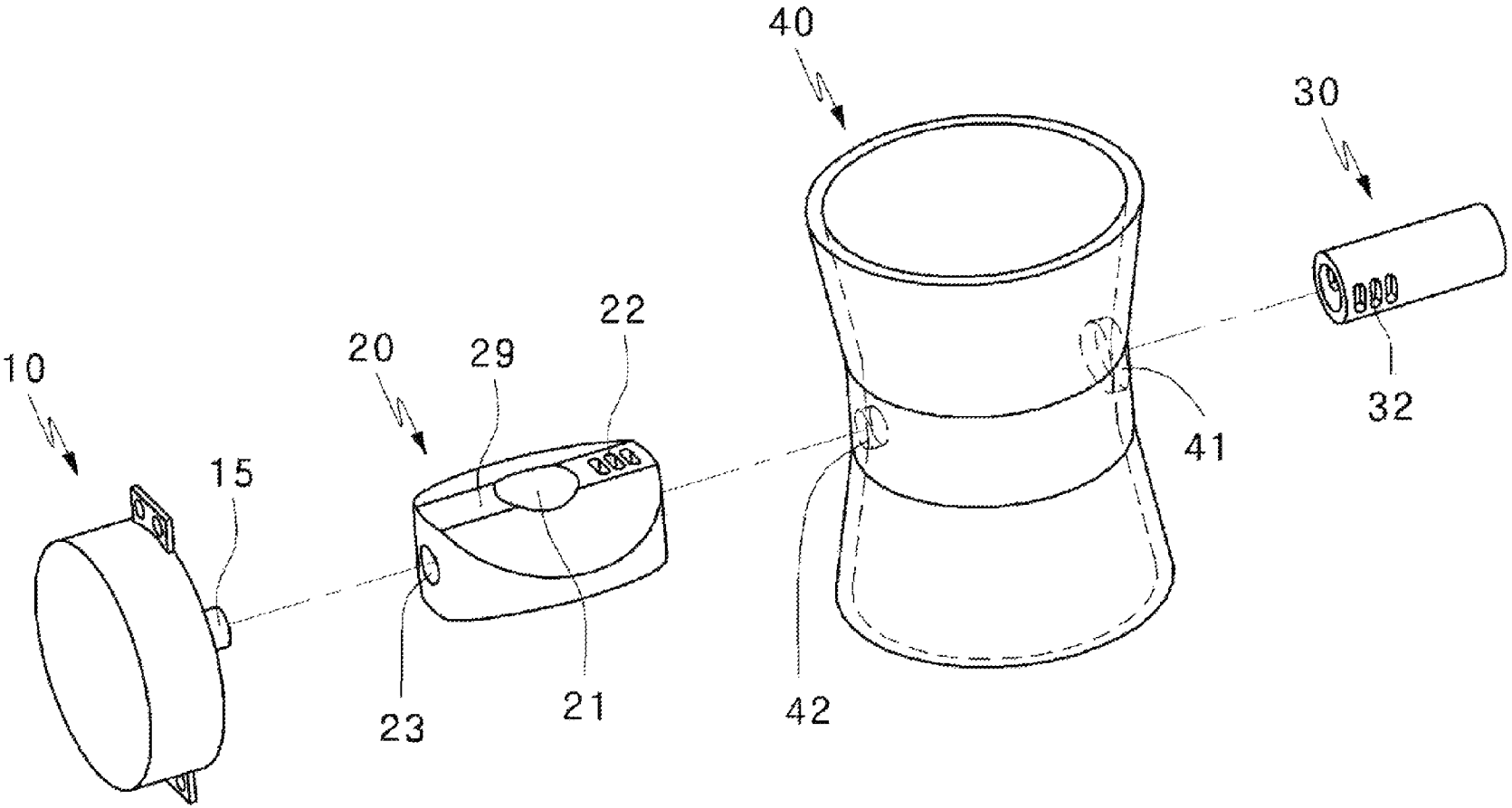
FIG. 1 is an exploded perspective view showing the dual venturi according to the first embodiment of the present invention.
Figure 2A:
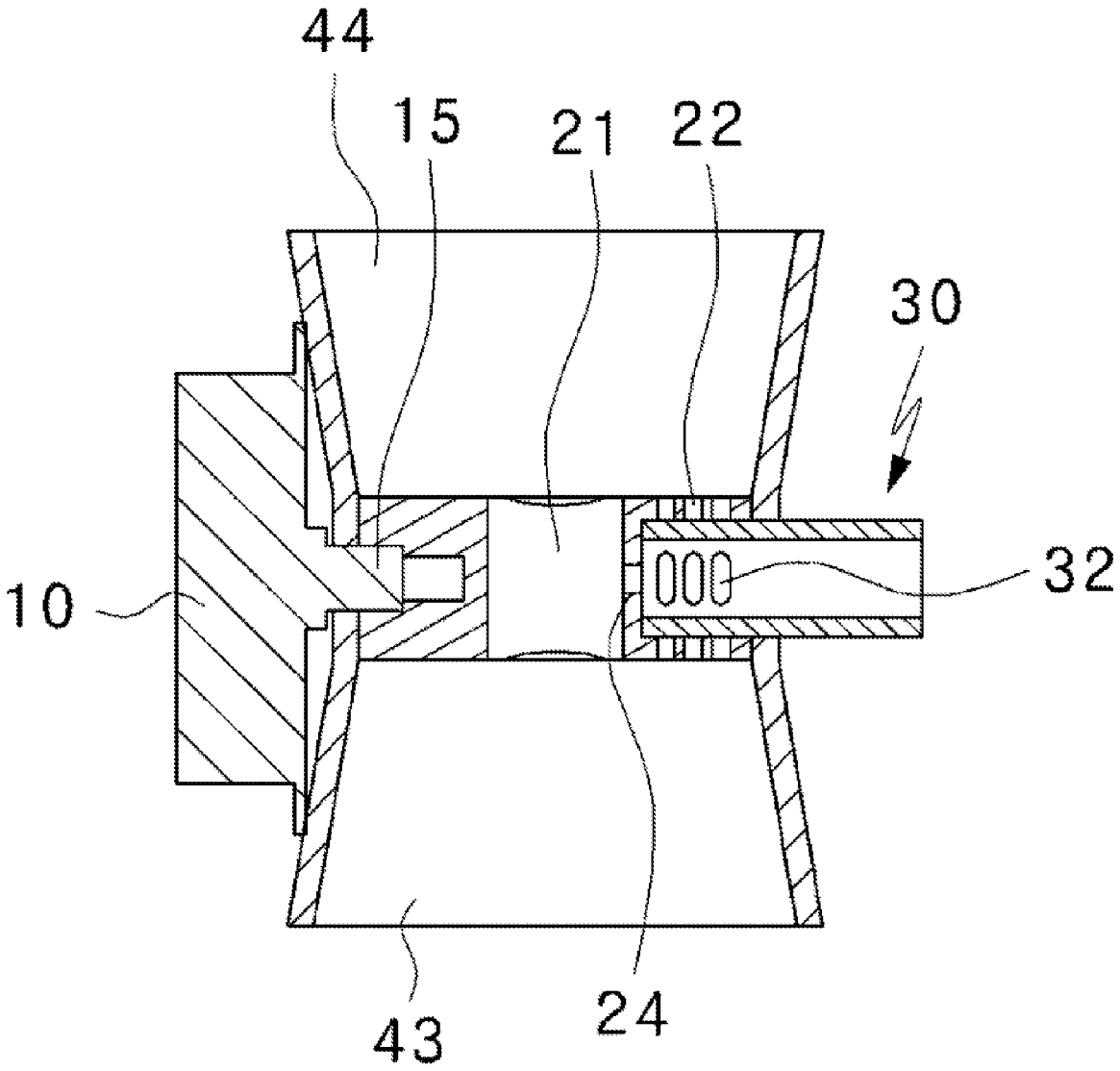
FIG. 2*a* shows a first embodiment of the present invention, that is a longitudinal sectional view of the dual venturi with the damper part in a closed state.
Figure 2B:
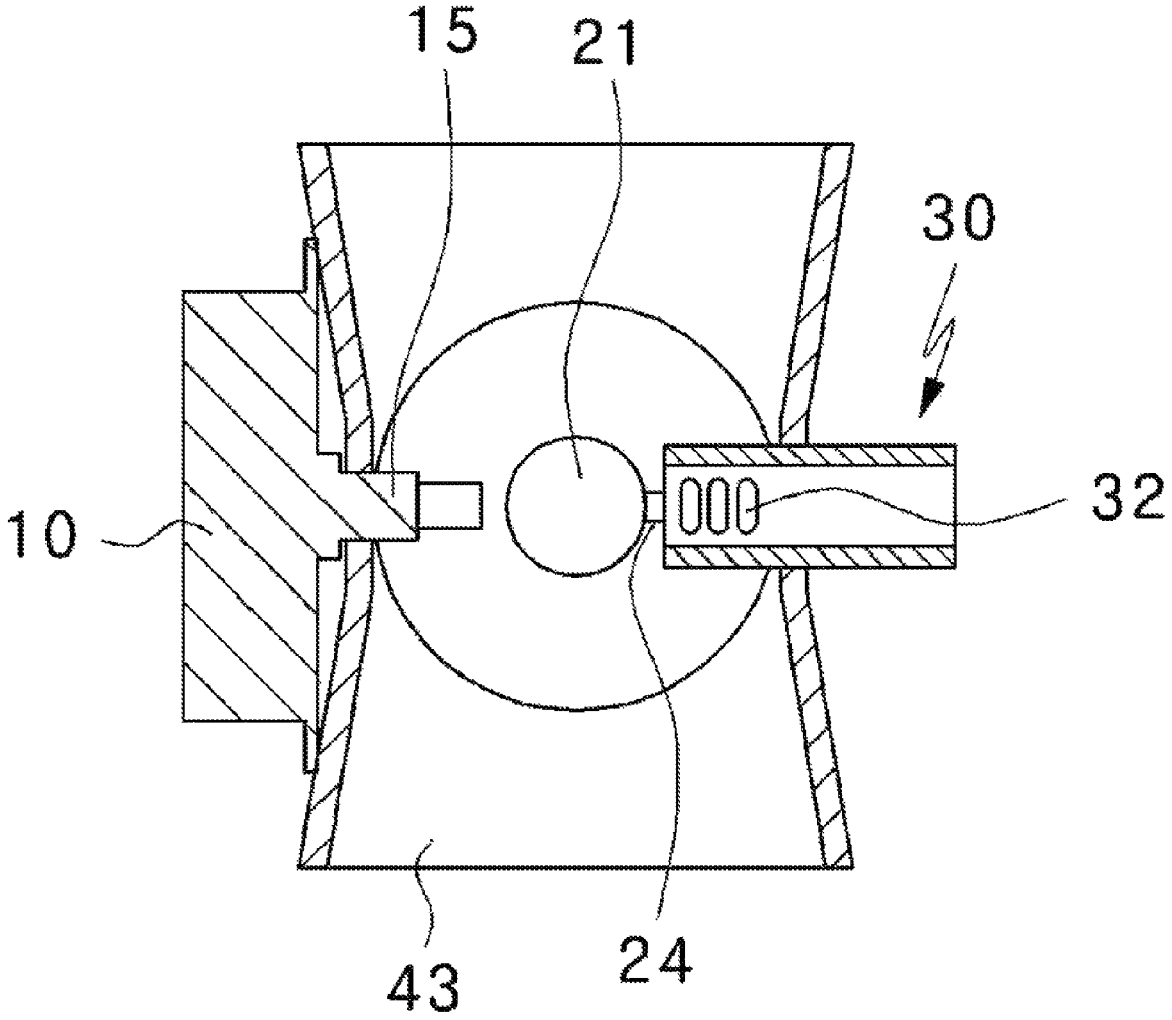
FIG. 2*b* is a longitudinal sectional view showing the dual venturi with the damper part in an open state.

First, the overall structure of the dual venturi is explained with reference to FIG. 1, FIG. 2*a* and FIG. 2*b*. FIG. 1 is an exploded perspective view defining the dual venturi according to the first embodiment of the present invention, FIG. 2*a* shows a first embodiment of the present invention, that is a longitudinal sectional view of the dual venturi with the damper in a closed state, and FIG. 2*b* is a longitudinal sectional view showing the dual venturi with the damper in a open state, respectively.

The dual venturi according to the present invention comprises a tubular part (40) as a passageway duct through which air passes through; a damper part (20) for opening/closing the secondary air passageway that is formed on the tubular part (40) and extends in the direction of the lower portion (43) to the upper portion (44) of the tubular part (40); a driving part (10) in which the rotational shaft (15) of the motor, that is inserted through the tubular part-side second hole (42) while being connected to the lateral surface of the damper part (40), is connected to the damper part-side first hole (23) to rotate the damper part (20); and a cylindrical gas inlet (30) inserted through the first hole (41) of the tubular part (40) and connected to the damper part-side second hole (27) (Refer to FIG. 3*c*) to provide primary gas and secondary gas through the damper part (20).

As illustrated in FIG. 1, the tubular part (40) has a central diameter that is smaller than the diameter of both ends of the higher and lower portions, thus the central passageway is narrowly formed. This configuration can be more clearly understood from FIG. 2*a* and FIG. 2*b*. However, the shape of the tubular part (40) can be a cylindrical shape with equal upper and lower portions, and the present invention is not particularly limited to this shape.

The damper part (20) comprises an overall donut-shaped body part (29), which has a central passageway (21) formed in the central thereof, and a damper part-side secondary gas outlet (22) having three slot-type holes, through which secondary gas is discharged, is formed on the upper surface of the body part. The body part (29) corresponding thereto can also have a secondary gas outlet. That is, it is seen in FIG. 2*a* that the damper part-side secondary gas outlet (22) formed on the upper surface of the damper part (20) is also formed on the corresponding lower portion. The number of the slot-type holes can be suitably selected according to need, and its shape can also be varied.

Further, the central passageway (21) of the damper part (20) is the passageway through which the primary air passes through at closed state. As a first embodiment of the present invention, it is seen that it is a venturi shape similar to the tubular part (40) shape that is the passageway for the secondary air. As shown in FIG. 2*a* and FIG. 2*b*, the central passageway (21) of the damper part (20) has a damper part-side primary gas outlet (24) through which primary gas is discharged.

The gas inlet (30) is cylindrically shaped, and is connected to the damper part-side second hole (27) via insertion through the tubular part-side first hole (41). Here, the gas inlet (30) does not rotate but the damper part (20) can, thus the gas inlet (30) also functions as a stationary shaft to rotate the damper part (20) together with the rotational shaft (15).

The damper part-side opening of the gas inlet (30) forms the gas inlet-side primary gas outlet (33) and maintains an open connection to the damper part-side primary gas outlet (24) at all times.

A gas inlet-side secondary gas outlet (32) having an identical shape to the damper part-side secondary gas outlet (22) is formed on the circumference of the area near the damper part-side of the gas inlet (30). The gas inlet part-side secondary gas outlet (32) is also symmetrically shaped and can form outlets on both sides of the pipe or form an outlet only on one side. FIG. 2*a* illustrates a closed state of the damper part (20), that is the state in which the upper and lower passageways of the tubular part (40) are blocked and only the central passageway (21) of the damper part (20) is used as the primary air passageway of the tubular part (40). In other words, the state in which the damper part (20) is placed in the cross-sectional direction, that is the horizontal plane of the tubular part (40), only the gas inlet-side primary gas outlet (33) is open towards the damper part-side primary gas outlet (24), and the gas inlet part-side secondary gas outlet (32) is closed.

FIG. 2*b* illustrates opened state of the damper part (20), that is the state in which the upper and lower passageways of the tubular part (40) are open, thus most of the horizontal plane passageway in the cross-sectional direction of the tubular part (40) is substantially used as the air passageway, the so-called secondary air passing state. Here, the damper part (20) is placed in the vertical plane that is perpendicular to the horizontal plane, and the gas inlet-side primary gas outlet (33) as well as the gas inlet-side secondary gas outlet (32) are both open towards the damper part-side secondary gas outlet (22). As a result, all functions of the first step distribution and second step distribution can be executed.

Hereafter, operation of the dual venturi according to the first embodiment of the present invention will be described in detail with reference to FIG. 3*a* to FIG. 5*b*. Parts not thoroughly explained in the above detailed description will be explained through the additional configuration.

Figure 3A:
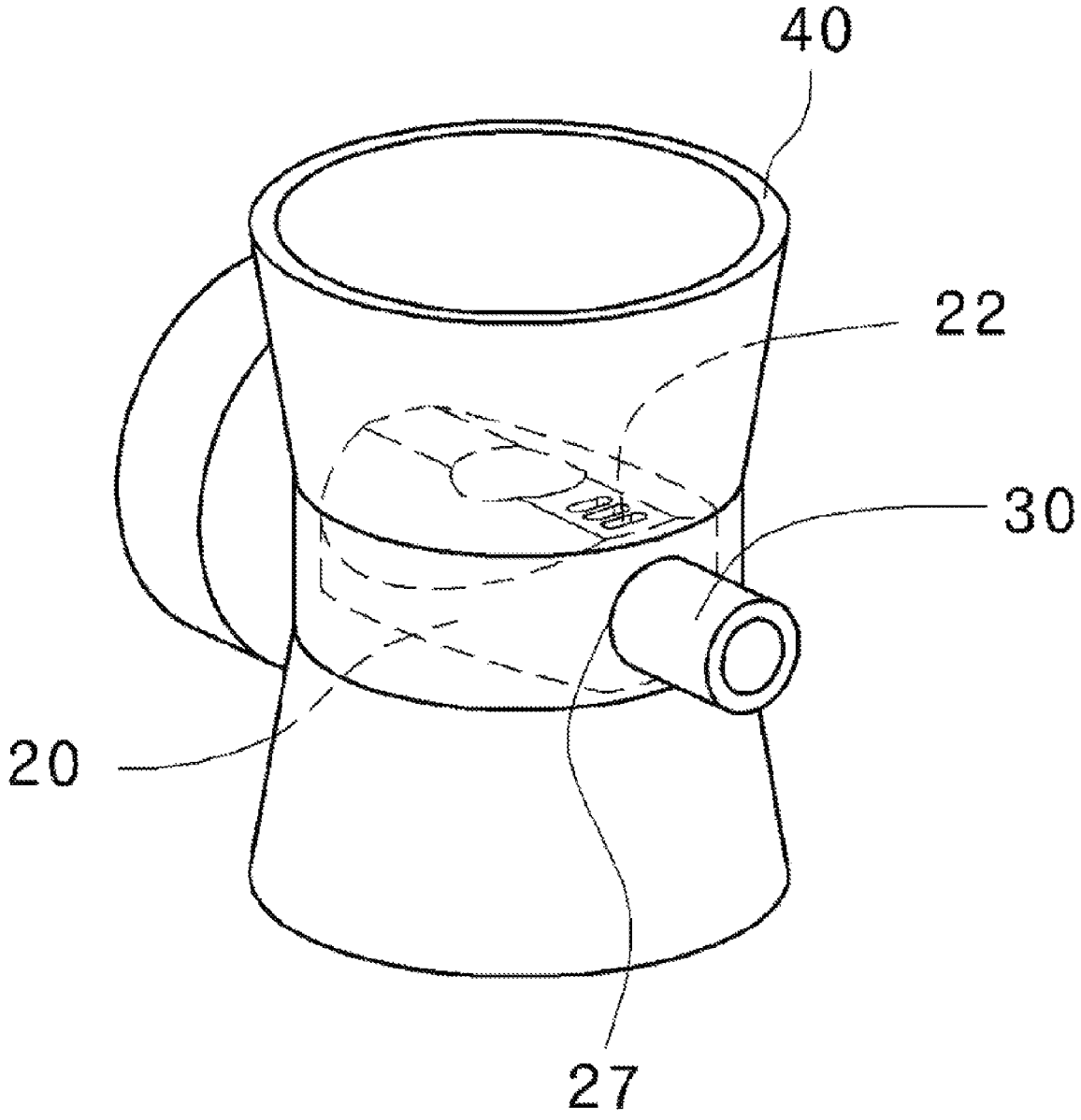
FIG. 3*a*, FIG. 3*b* and FIG. 3*c* show a first embodiment of the present invention, that is a diagram showing the damper part in the closed state.
Figure 3B:
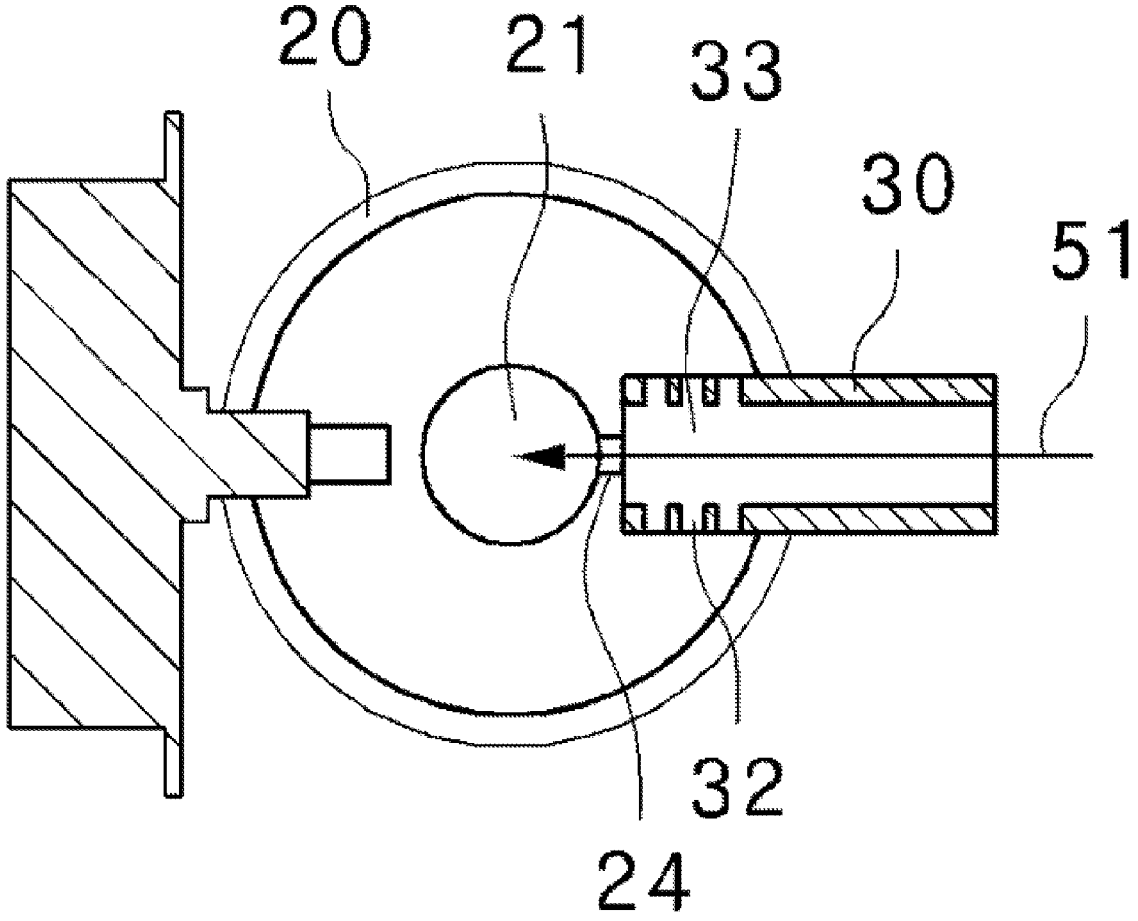
Figure 3C:
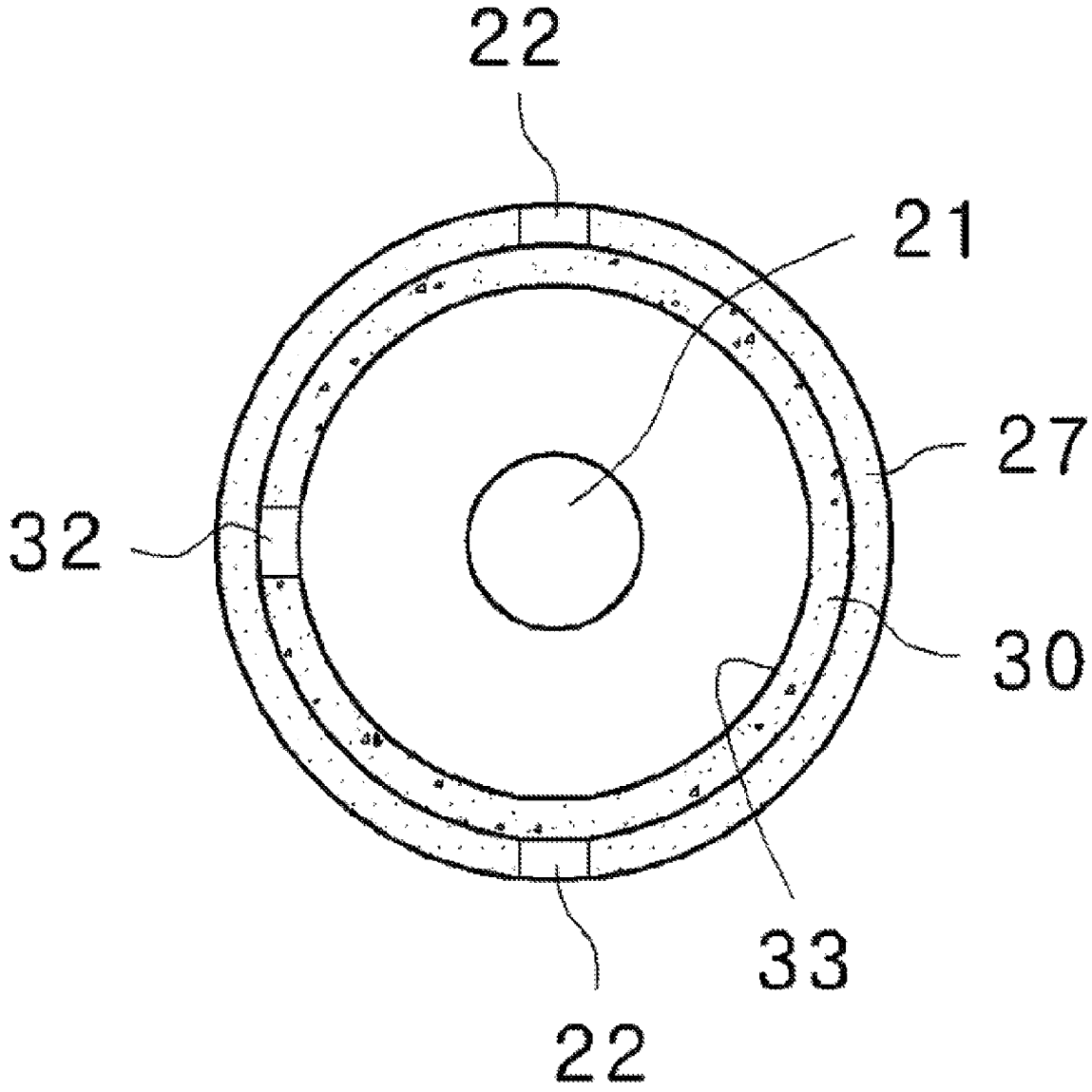

First, FIG. 3*a*, FIG. 3*b* and FIG. 3*c* show a first embodiment of the present invention, that is a diagram showing the closed state of the damper (20). FIG. 3*a* is a perspective view of the dual venturi, FIG. 3*b* is a planar sectional view of the dual venturi and FIG. 3*c* is a sectional view showing the positional relationship between the gas inlet and the secondary gas outlets of the damper part.

As shown in the perspective view of FIG. 3*a*, when the damper part (20) is closed, the positional relationship between the tubular part (40) and the damper part (20) is equal to when the damper part (20) blocks the entire upper and lower air passageways of the tubular part (40), and only the central passageway (21) of the damper part (20) substantially becomes the air passageway (primary air passageway) of the tubular part (40). In other words, the damper part (20) is placed in the horizontal plane in the cross-sectional direction of the tubular part (40), and at this time, as shown in FIG. 3*b*, only the gas inlet-side primary gas outlet (33) is connected to the damper part-side primary gas outlet (24) so that primary gas (51) flows through the central passageway (21), and the gas inlet-side secondary gas outlet (32) is blocked by the wall of the damper part-side second hole (27) and thus closed, as shown in FIG. 3*c*. That is, a small quantity of relatively low level primary air and primary gas flow through the tubular part in the closed state.

Figure 4A:
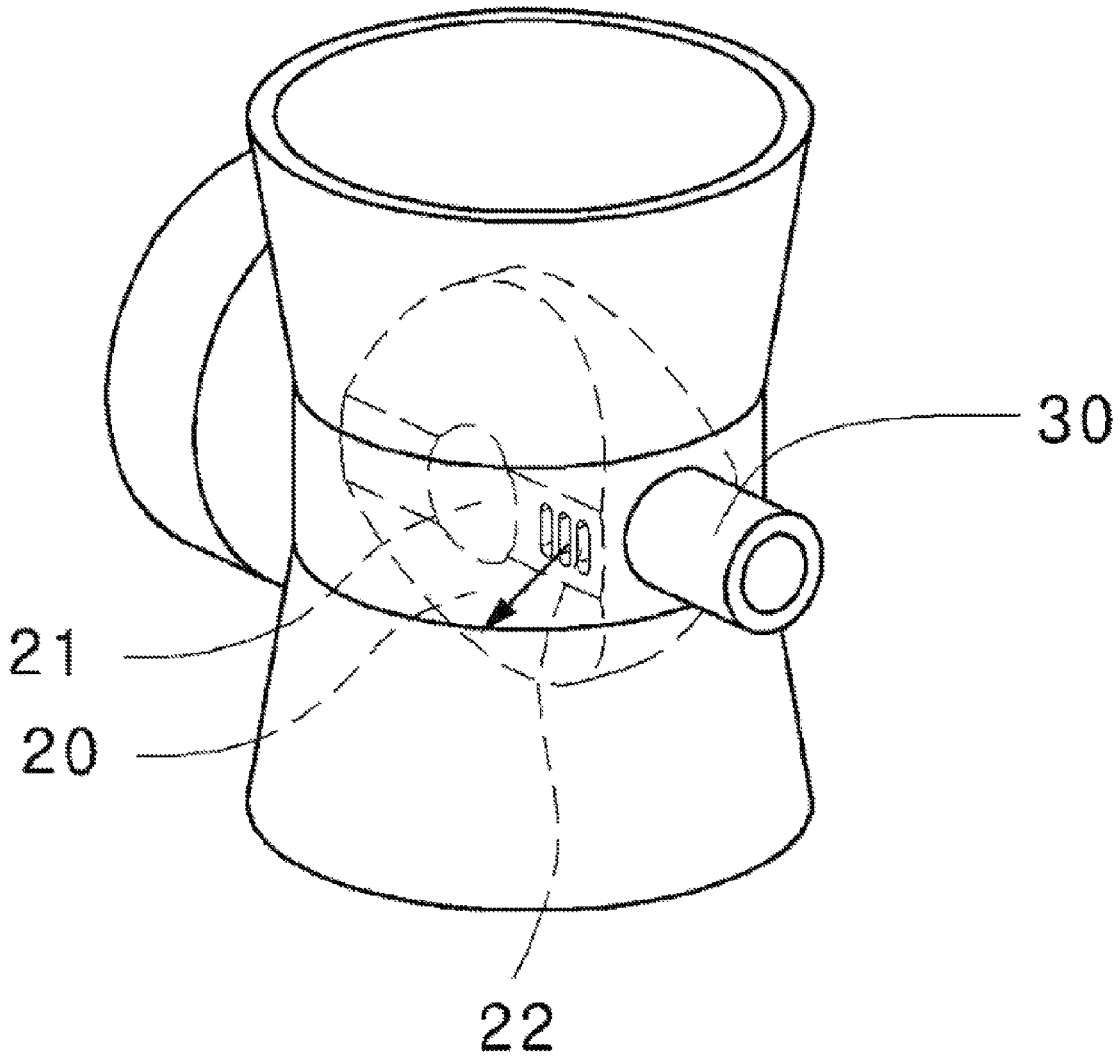
FIG. 4*a*, FIG. 4*b* and FIG. 4*c* show a first embodiment of the present invention, that is a diagram showing the damper in the open state.
Figure 4B:
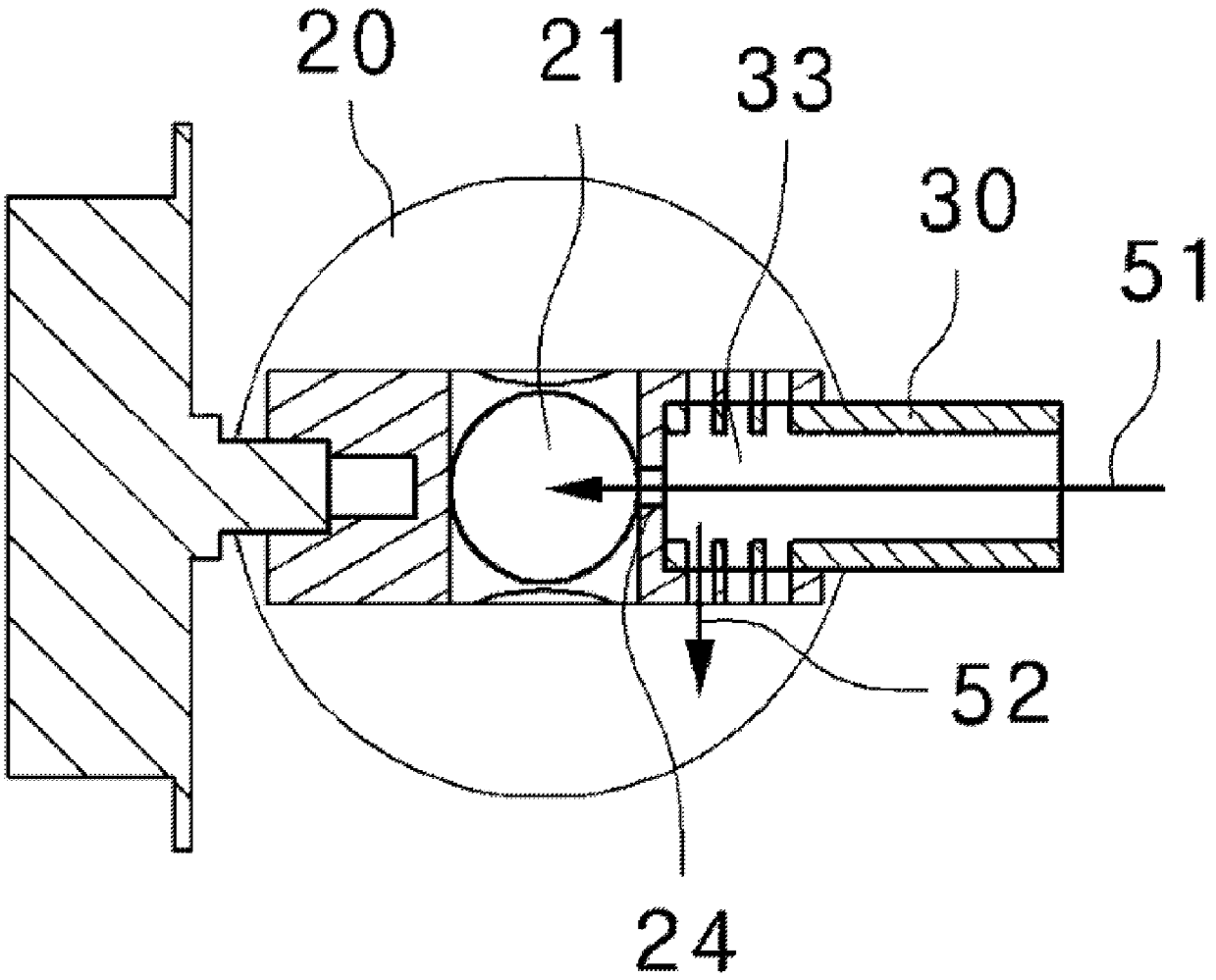
Figure 4C:
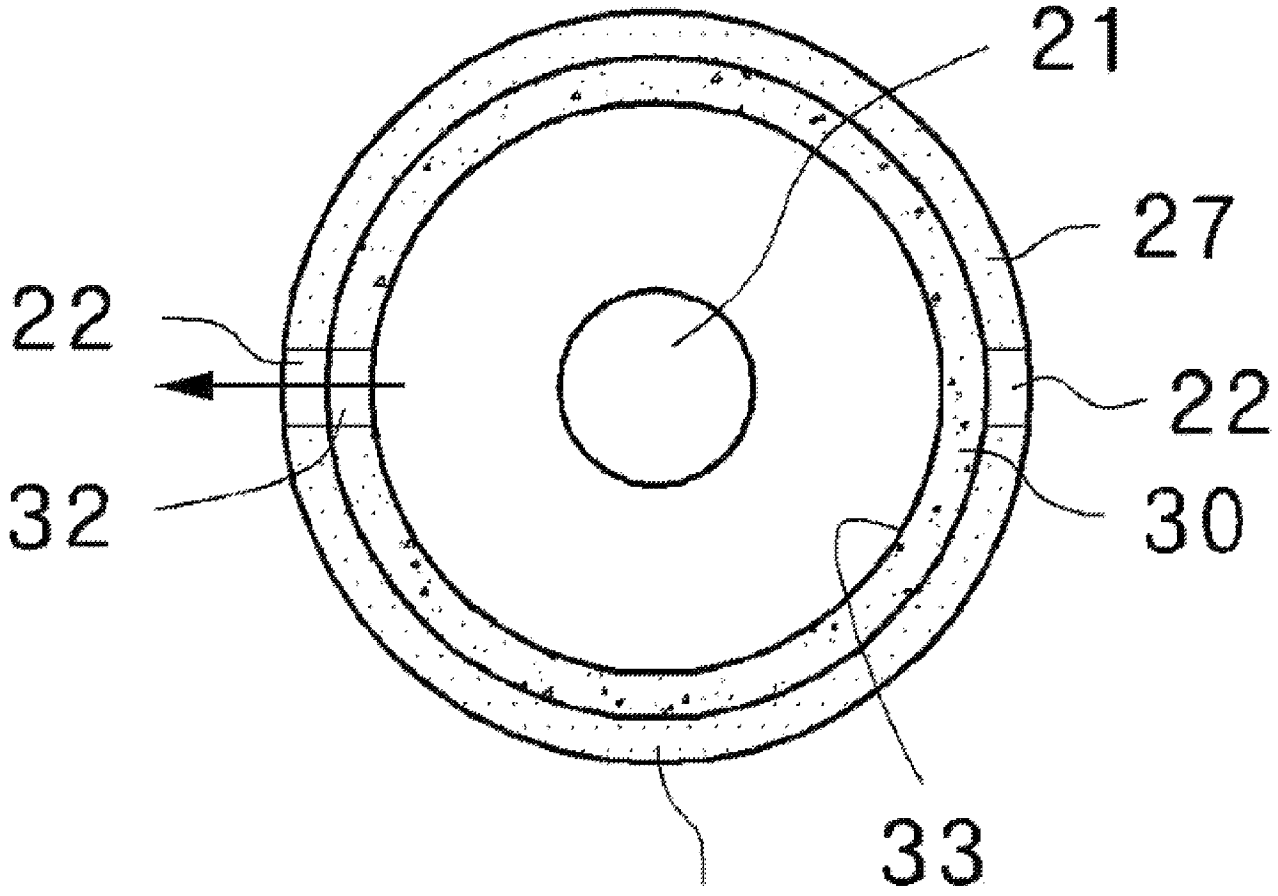

FIG. 4*a*, FIG. 4*b* and FIG. 4*c* show a first embodiment of the present invention, that is a diagram showing the open state of the damper. FIG. 4*a* is a perspective view of the dual venturi, FIG. 4*b* is a planar sectional view of the dual venturi and FIG. 4*c* is a sectional view showing the positional relationship between the gas inlet and the secondary gas outlets of the damper part.

As shown by the perspective view of FIG. 4*a*, when the damper part (20) is opened, the positional relationship between the tubular part (40) and the damper part (20) is equal to when the damper part (20) substantially opens the entire upper and lower air passageways of the tubular part (40), thereby the entire passageway becomes the air passageway (secondary air passageway). In other words, the damper part (20) is placed upright perpendicularly to the horizontal plane in the closed state, that is the vertical plane to the cross-sectional direction of the tubular part (40). At this time, as shown in FIG. 4*b*, the gas inlet-side primary gas outlet (33) is connected to the damper part-side primary gas outlet (24), so that the primary gas (51) flows through and also the gas inlet-side secondary gas outlet (32) is opened to let the secondary gas (52) flow out.

Referring to FIG. 4*c*, the gas inlet-side secondary gas outlet (32) and the damper part-side secondary gas outlet (22) formed on the wall of the damper part-side second hole (27) correspond to each other and thereby are connected.

In this embodiment, the gas inlet-side secondary gas outlet (32) is formed only on one part of the circumference diameter such that only one lateral surface (for instance, the upper direction-side surface of the upper and lower directions of the tubular part (40)) of the damper part (20) releases secondary gas (52). However, for instance, the gas inlet-side secondary gas outlet (32) can be installed on the opposite side (that is, 180°) of the cylindrical gas inlet (30) wall circumference to release secondary gas in the upper and lower directions of the damper part (20).

In this embodiment, the damper part-side primary gas outlet (24) has a cross-sectional area that is set smaller than the opening of the gas inlet (30) side primary gas outlet (33), and the mutual opening ratio thereof can be suitably determined as necessary.

Figure 5A:
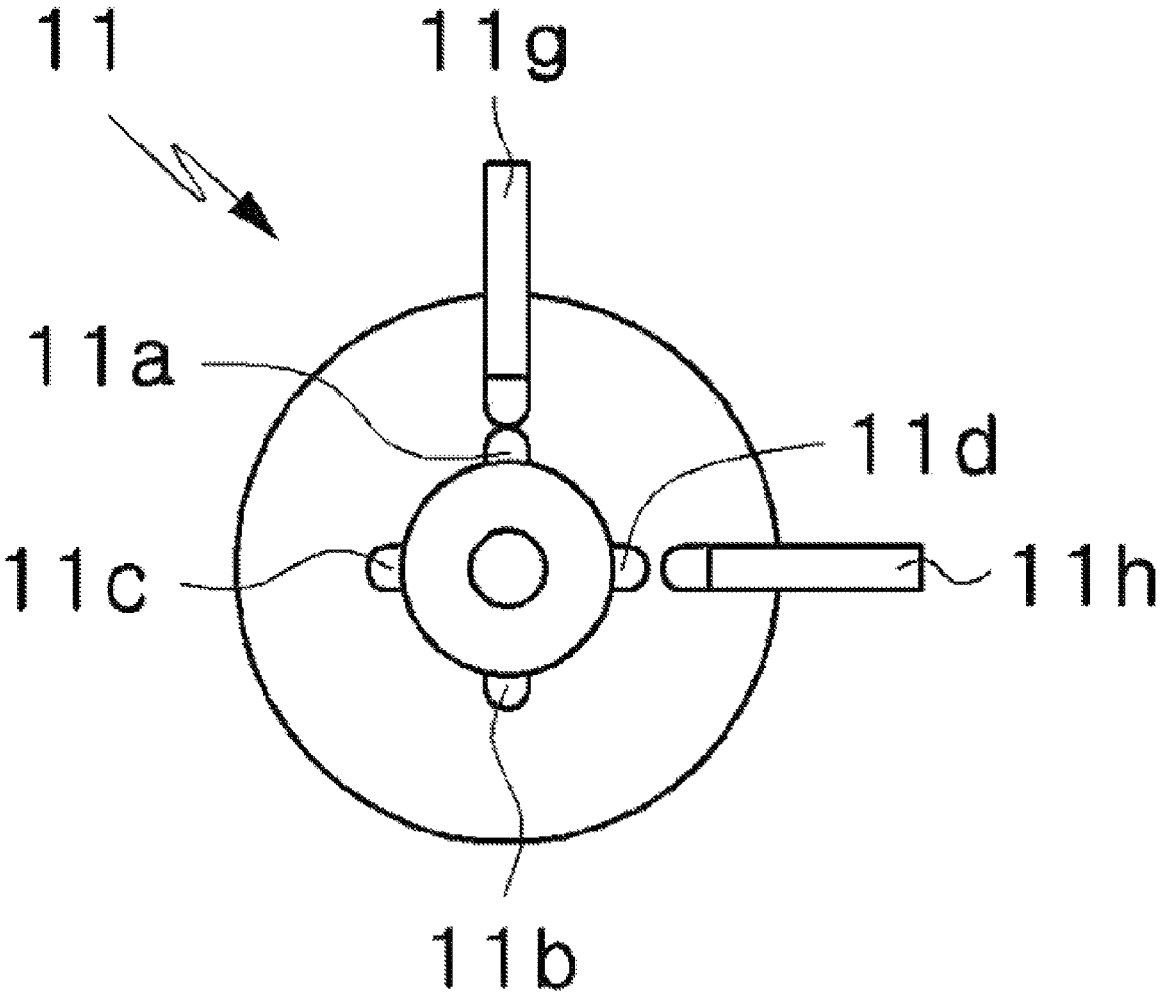
FIG. 5*a* and FIG. 5*b* show the positional relationship between gas inlet-side secondary gas outlet and the damper part at the limit switch of the driving part.
Figure 5B:
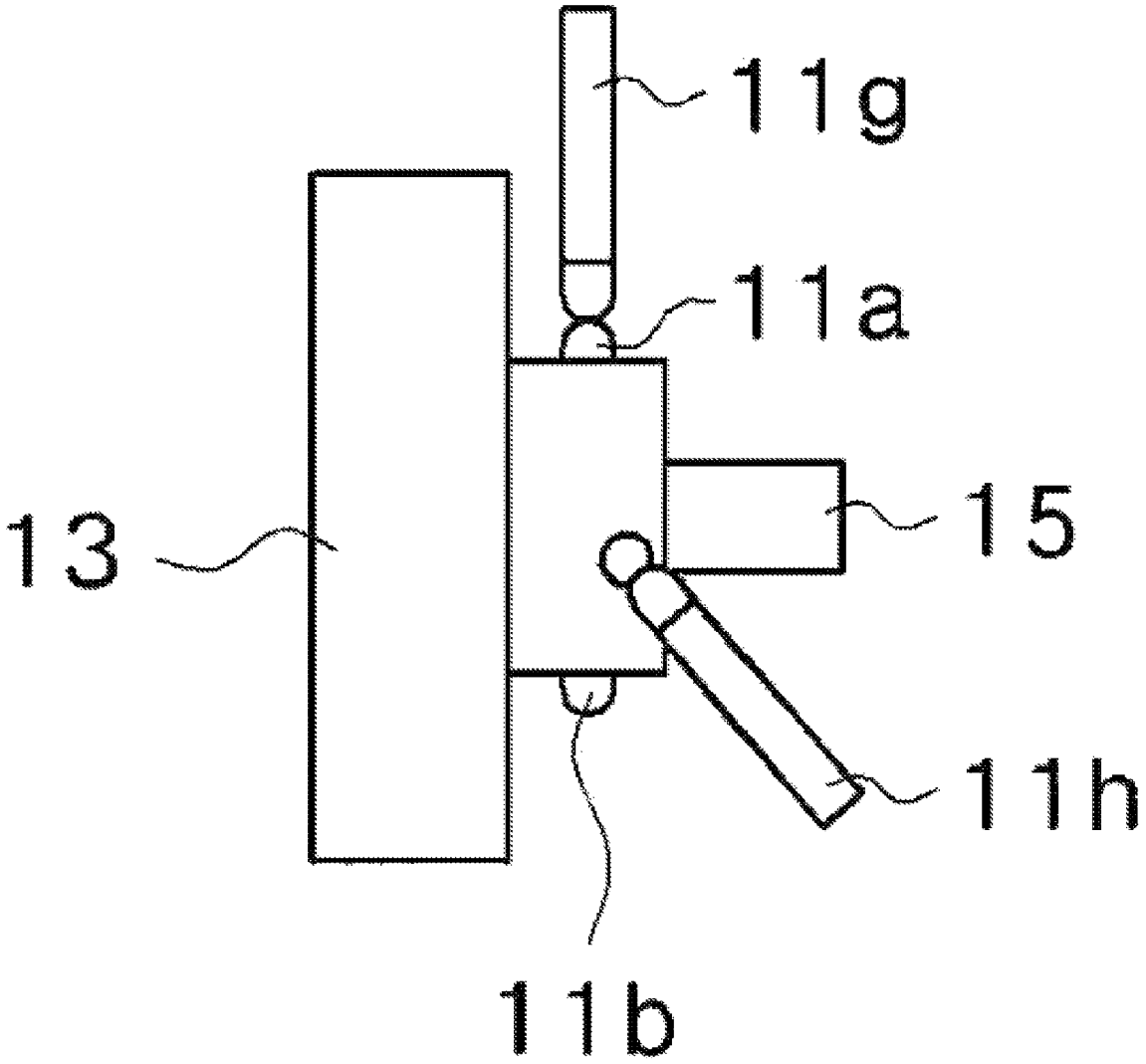

FIG. 5*a* and FIG. 5*b* show the positional relationship between the gas inlet-side secondary gas outlet and the damper part at the limit switch of the driving part. FIG. 5*a* is a planar view of the limit switch and FIG. 5*b* is a lateral view of the limit switch, respectively.

In the limit switch (11) shown in FIG. 5*a*, reference signs 11*a* and 11*b* show the position points of the damper part-side secondary gas outlet, 11*c* and 11*d* respectively show the position points of the gas inlet-side secondary gas outlet, 11*g* shows the damper part-side positional probe, and 11*h* shows the gas inlet-side positional probe, respectively. One of the damper part-side secondary gas outlet position points (11*a*)(11*b*) is positioned at the damper part-side positional probe (11*g*), and in the same manner if one of the gas inlet-side secondary gas outlet position points (11*c*)(11*d*) corresponds to the gas inlet-side positional probe (11*h*), secondary air and secondary gas are blocked, as shown in FIG. 3*c*. That is, it shows the state in which the damper part (20) is at the horizontal plane position.

Further, on the contrary, if one of the gas inlet-side secondary gas outlet position points (11*c*)(11*d*) corresponds to the damper part-side positional probe (11*g*), and at the same time one of the damper part-side secondary gas outlet position points (11*a*)(11*b*) is positioned at the gas inlet-side positional probe (11*h*), the secondary air and secondary gas are open to flow through the tubular part (40), as shown in FIG. 4. That is, this shows the state in which the damper part (20) is vertically positioned.

Referring to FIG. 5*b*, a synchronous motor is used as the motor (13) included in the driving part (10) and the rotational shaft (15) of the direct motor (13) can be connected to the damper part-side first hole (23). Thus, components necessary for the AC motor in the prior art such as a wire, or return spring can be removed, allowing the dual venturi of the present invention to be more simplified compared to the prior art.

Hereafter, the second embodiment of the present invention will be described in detail with reference to FIG. 6 to FIG. 10*b*. Configurations substantially identical to the first embodiment are indicated with the same reference signs.

Figure 6:
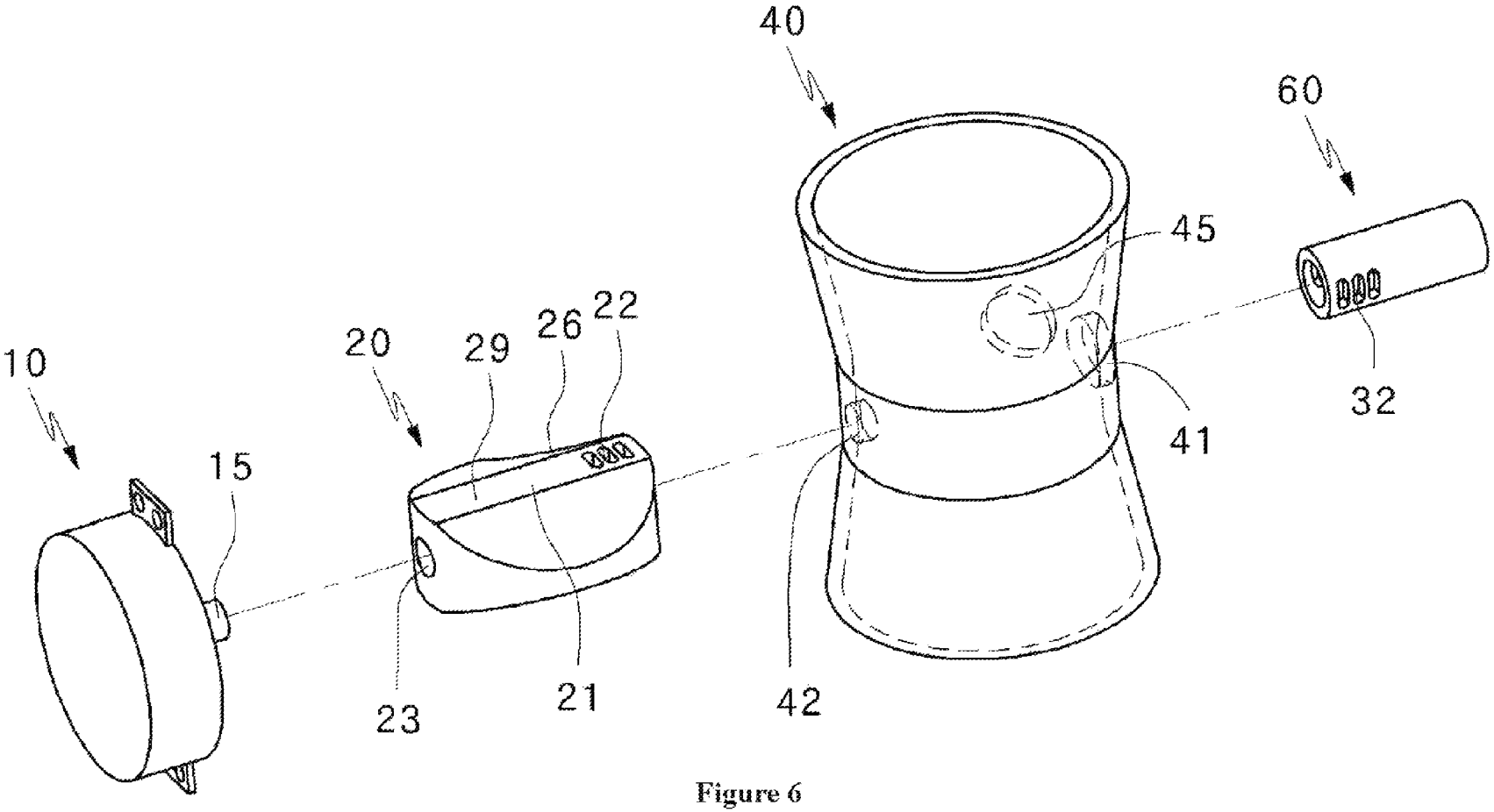
FIG. 6 is an exploded perspective view of the dual venturi according to the second embodiment of the present invention.
Figure 7A:
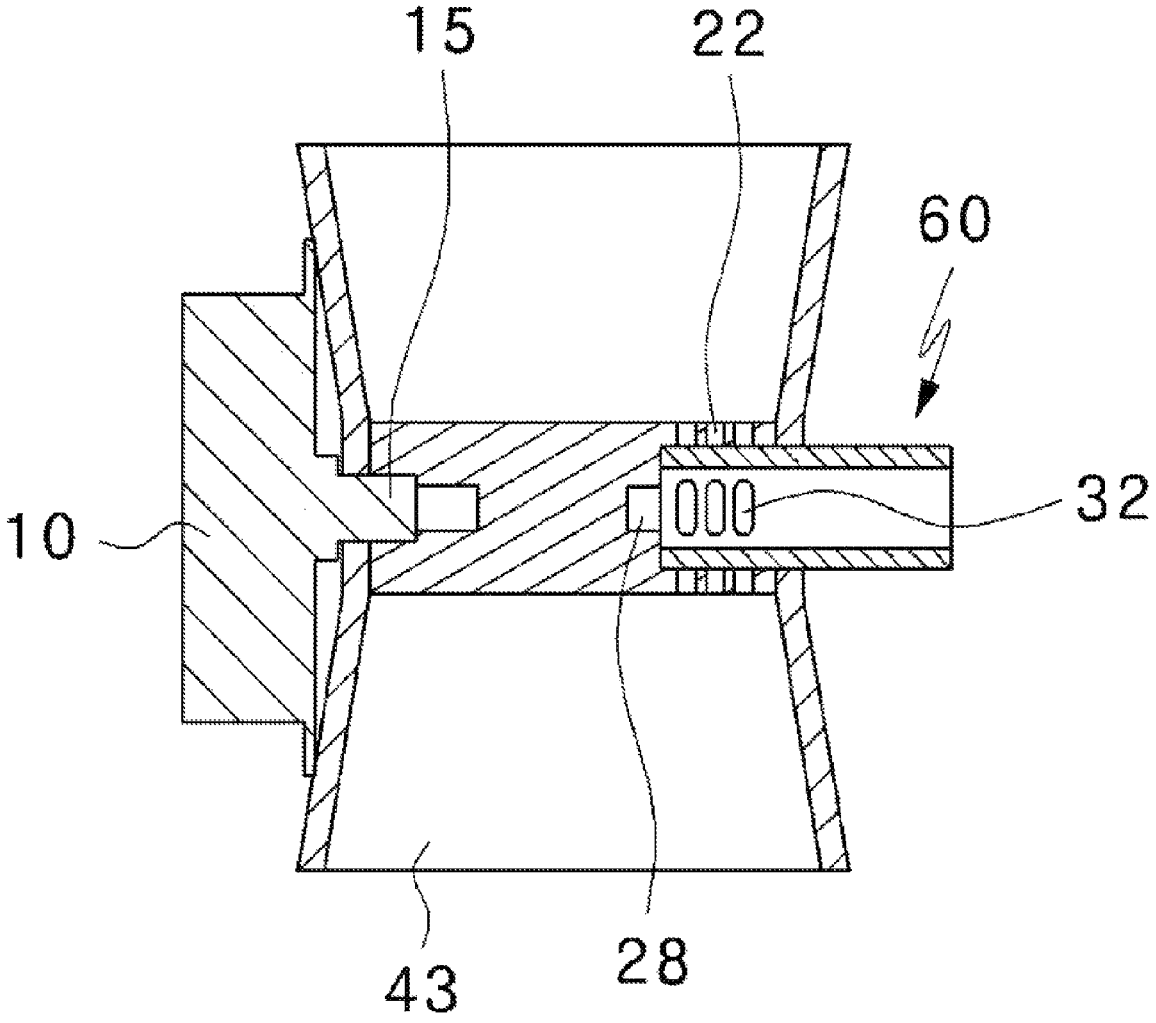
FIG. 7*a* shows a second embodiment of the present invention, that is a longitudinal sectional view of the dual venturi with the damper in a closed state.
Figure 7B:
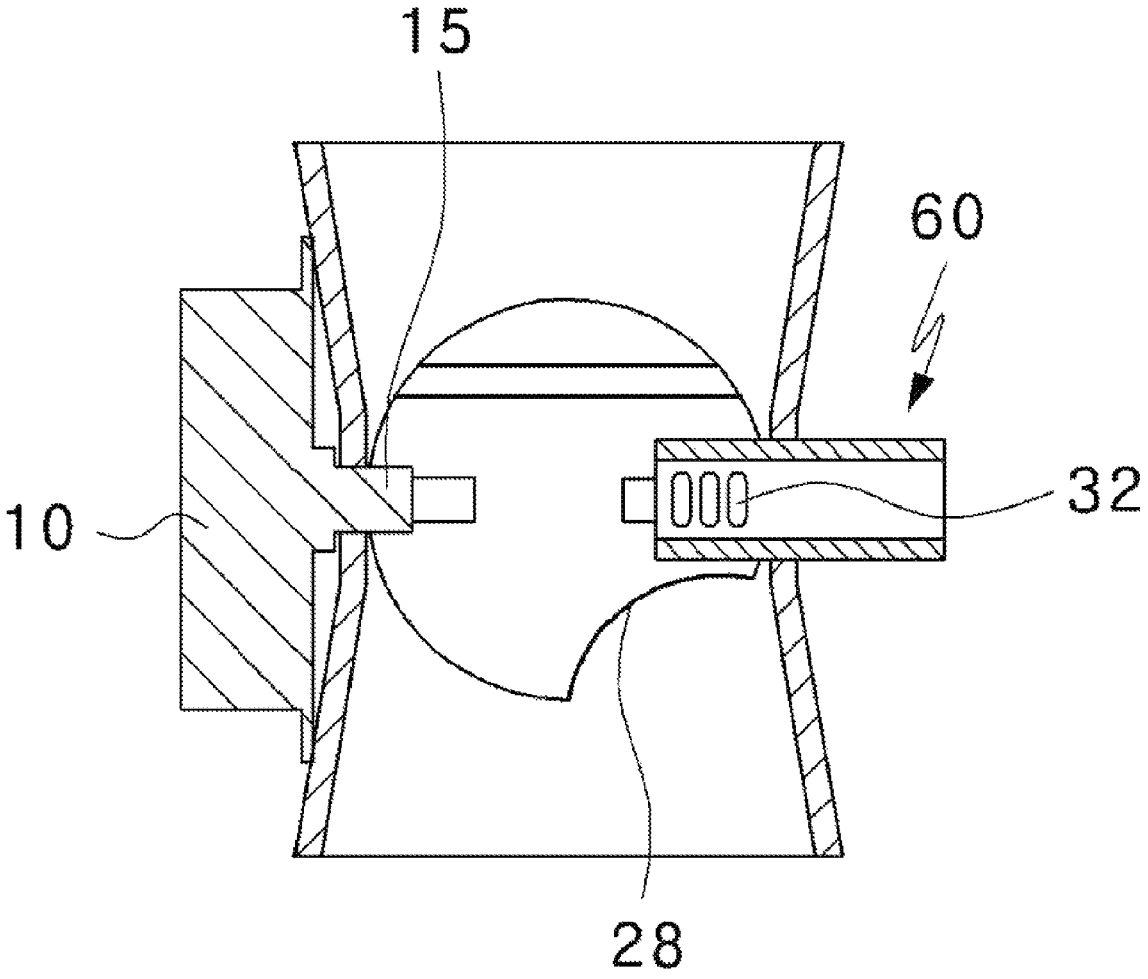
FIG. 7*b* is a longitudinal sectional view showing the dual venturi with the damper in a open state.

First, the second embodiment showing the overall structure of the dual venturi according to the present invention will be described in detail with reference to FIG. 6, FIG. 7*a* and FIG. 7*b*. FIG. 6 is an exploded perspective view defining the dual venturi according to the second embodiment of the present invention, FIG. 7*a* shows a second embodiment of the present invention, that is a longitudinal sectional view of the dual venturi with the damper in a closed state, and FIG. 7*b* is a longitudinal sectional view showing the dual venturi with the damper in an open state, respectively.

The dual venturi according to the present invention comprises, a tubular part (40), that is a passageway duct through which air passes through, having a primary gas inlet (45) at the center of the lateral wall; a damper part (20) for opening/closing the secondary air passageway that is formed on the tubular part (40) and extends in the direction from the lower portion (43) to the upper portion (44) of the tubular part (40); a driving part (10) connected to the lateral surface of the damper part (40), with the rotational shaft (15) of the motor, that is inserted through the tubular part-side second hole (42), being connected to the damper part-side first hole (23) to rotate the damper part (20); and a cylindrical secondary gas inlet (60) inserted through the first hole (41) of the tubular part (40) and connected to the damper part-side second hole (27) (Refer to FIG. 8*c*) to provide secondary gas through the damper part (20).

As shown in FIG. 6, the tubular part (40) has a central diameter that is smaller than the diameter of both ends of the upper and lower portions, thus the central passageway is narrowly formed. This configuration can be more clearly understood from FIG. 7*a* and FIG. 7*b*. However, the shape of the tubular part (40) can be a cylindrical shape with equal upper and lower portions, and the present invention is not particularly limited to this shape.

The damper part (20) comprises a body part (29) having an overall disk shape with a portion of it removed, and a cutout part (26) that is formed by the removed portion of the body part circumference, in which the upper surface of the body part (29) has a damper part-side secondary gas outlet (22) having four slot-type holes through which secondary gas flows out. The body part (29) corresponding thereto can also have a secondary gas outlet (22). That is, it is also seen on the lower portion corresponding to the secondary gas outlet (22). Further, four slot-type holes are shown, but its number can be suitably selected according to need and its shape can also be varied.

At the closed state, the cutout part (26) of the damper part (20) forms the passageway for the primary air to move through together with the internal-side wall of the tubular part (40). It may also be venturi-shaped, similar to the shape of the tubular part (40) which forms the second air passageway in the second embodiment of the present invention. As shown in FIG. 7*a* and FIG. 7*b*, the end part of the secondary gas inlet (60) in contact with the damper side (20) is also closed by the sealing hole (28) of the damper part.

The secondary gas inlet (60) is cylindrically shaped, and is connected to the damper part-side second hole (27) (Refer to FIG. 8*c*) via insertion through the tubular part-side first hole (41). Here, the secondary gas inlet (60) does not rotate but the damper part (20) can, thus the secondary gas inlet (60) also functions as a stationary shaft to rotate the damper part (20) together with the rotational shaft (15) of the motor. The damper part-side opening of the secondary gas inlet (60) is also closed by the sealing hole (28) as mentioned above, and a secondary gas inlet-side secondary gas outlet (32)) having an identical shape to the damper part-side secondary gas outlet (22) is formed on the circumference of the area near the damper part-side of the secondary gas inlet (60). The secondary gas inlet-side secondary gas outlet (32) is also symmetrically shaped and can form outlets on both sides of the pipe or form an outlet only on one side. FIG. 7*a* illustrates a closed state of the damper part (20), that is the state in which the upper and lower passageways of the tubular part (40) are closed and only the cutout part (26) of the damper part (20) is used as the primary air passageway of the tubular part (40). In other words, it is the state in which the damper part (20) is placed in the cross-sectional direction, that is the horizontal plane of the tubular part (40), only the primary gas inlet (45) is open towards the inner wall of the tubular part (40) (it maintains an open state at all times), and the secondary gas inlet-side secondary gas outlet (32) is closed.

FIG. 7*b* illustrates the opened state of the damper part (20), that is the state in which the upper and lower passageways of the tubular part (40) are open, thus most of the horizontal plane passageway in the cross-sectional direction of the tubular part (40) is substantially used as the air passageway, the so-called secondary air passing state. Here, the damper part (20) is placed in the vertical plane that is perpendicular to horizontal plane, and the primary gas inlet (45) as well as the secondary gas inlet-side secondary gas outlet (32) are both open towards the damper part-side secondary gas outlet (22). As a result, all functions of the first step distribution and second step distribution can be executed.

Next, operation of the dual venturi according to the second embodiment of the present invention will be described in detail with reference to FIG. 8*a* to FIG. 9*b*. Parts not thoroughly explained in the above detailed description will be explained through the additional configuration.

Figure 8A:
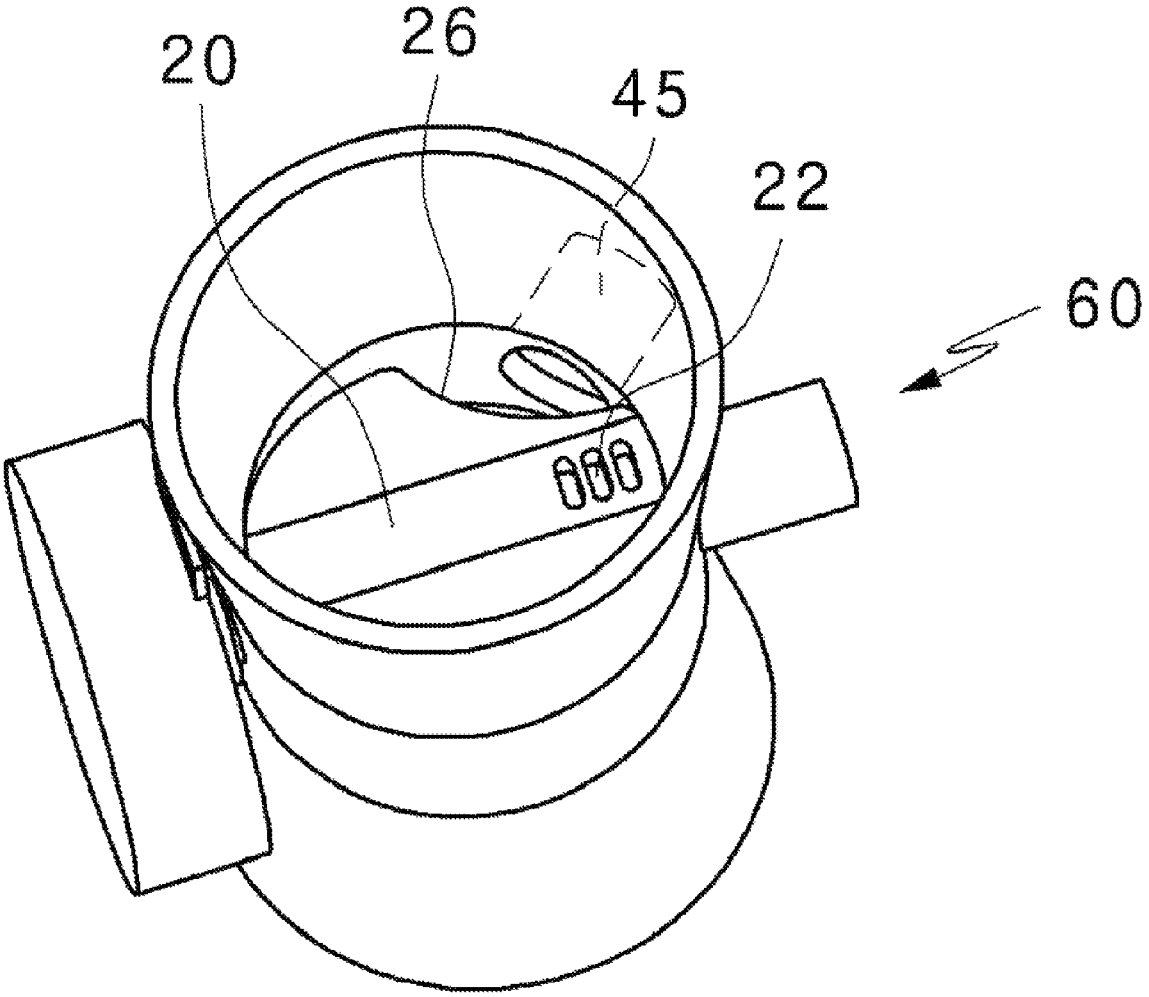
FIG. 8*a*, FIG. 8*b* and FIG. 8*c* show a second embodiment of the present invention, that is a diagram showing the damper in the closed state.
Figure 8B:
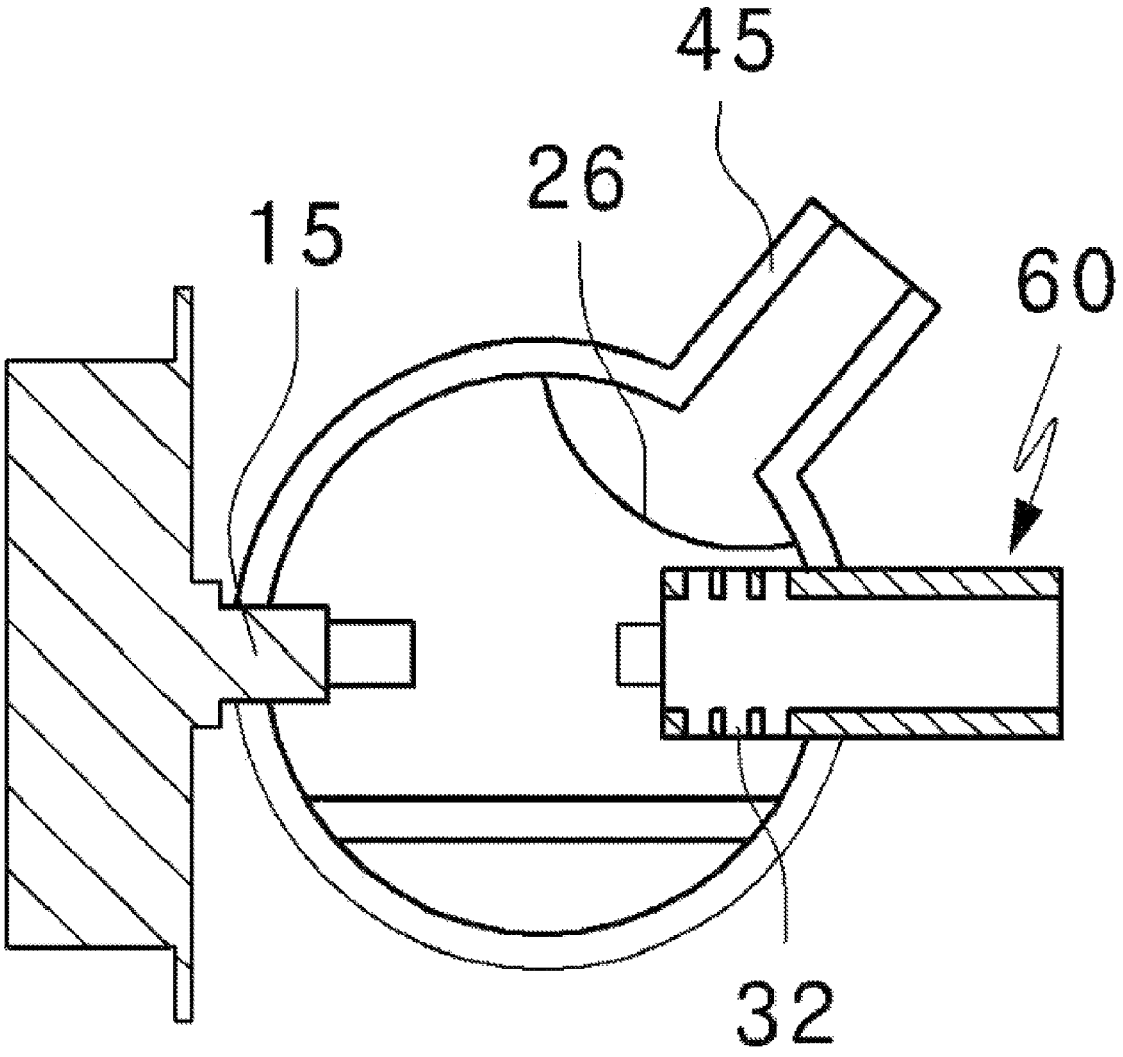
Figure 8C:
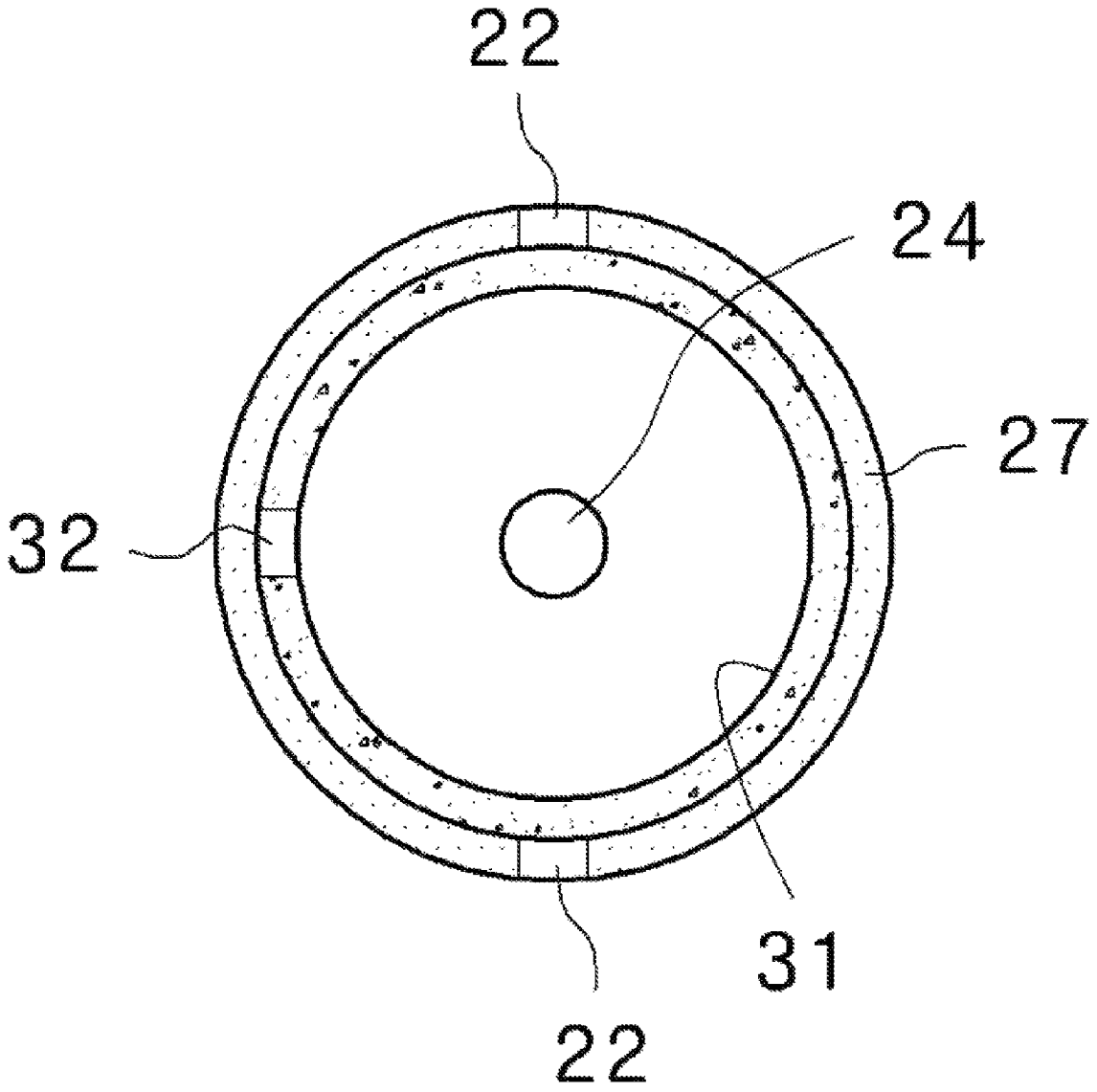

First, FIG. 8*a*, FIG. 8*b* and FIG. 8*c* show a second embodiment of the present invention, that is a diagram showing the damper (20) in the closed state. FIG. 8*a* is a perspective view of the dual venturi, FIG. 8*b* is a planar sectional view of the dual venturi and FIG. 8*c* is a sectional view showing the positional relationship between the secondary gas inlet and the secondary gas outlets of the damper part.

As shown in the perspective view of FIG. 8*a*, when the damper part (20) is closed, the positional relationship between the tubular part (40) and the damper part (20) is the state in which the upper and lower passageways of the tubular part (40) are closed by the damper part (20), and only the cutout part (26) of the damper part (20) and the arc shaped cross-sectional area formed by the interior wall of the tubular part are substantially used as the air passageway (first air passageway) of the tubular part (40). In other words, the state in which the damper part (20) is placed in the cross-sectional direction, that is the horizontal plane of the tubular part (40). Here, as shown in FIG. 8*b*, only the primary gas inlet part (45) is open towards the tubular part (40) (always at the opened state), thereby the primary gas flows through the tubular part (40) and the secondary gas inlet-side secondary gas outlet (32) is blocked by the damper part-side second hole (27) wall and closed, as shown in FIG. 8*c*. That is, during the closed state, a small amount of relatively low level primary air and primary gas flow through the tubular part. In this embodiment, the cutout part (45) and the primary gas inlet (45) face each other at the closed state of the damper part (20).

Figure 9A:
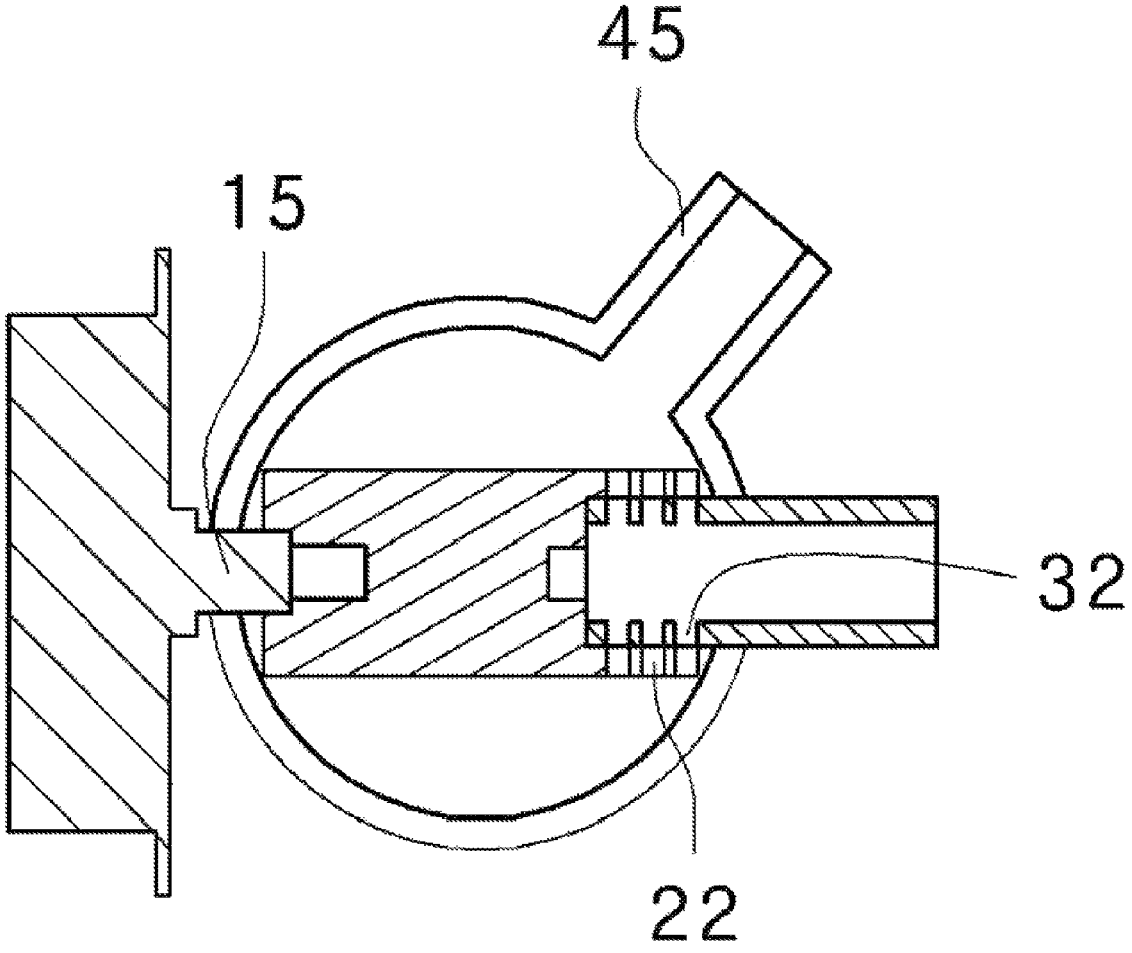
FIG. 9*a* and FIG. 9*b* show a second embodiment of the present invention, that is a diagram showing the damper in the open state.
Figure 9B:
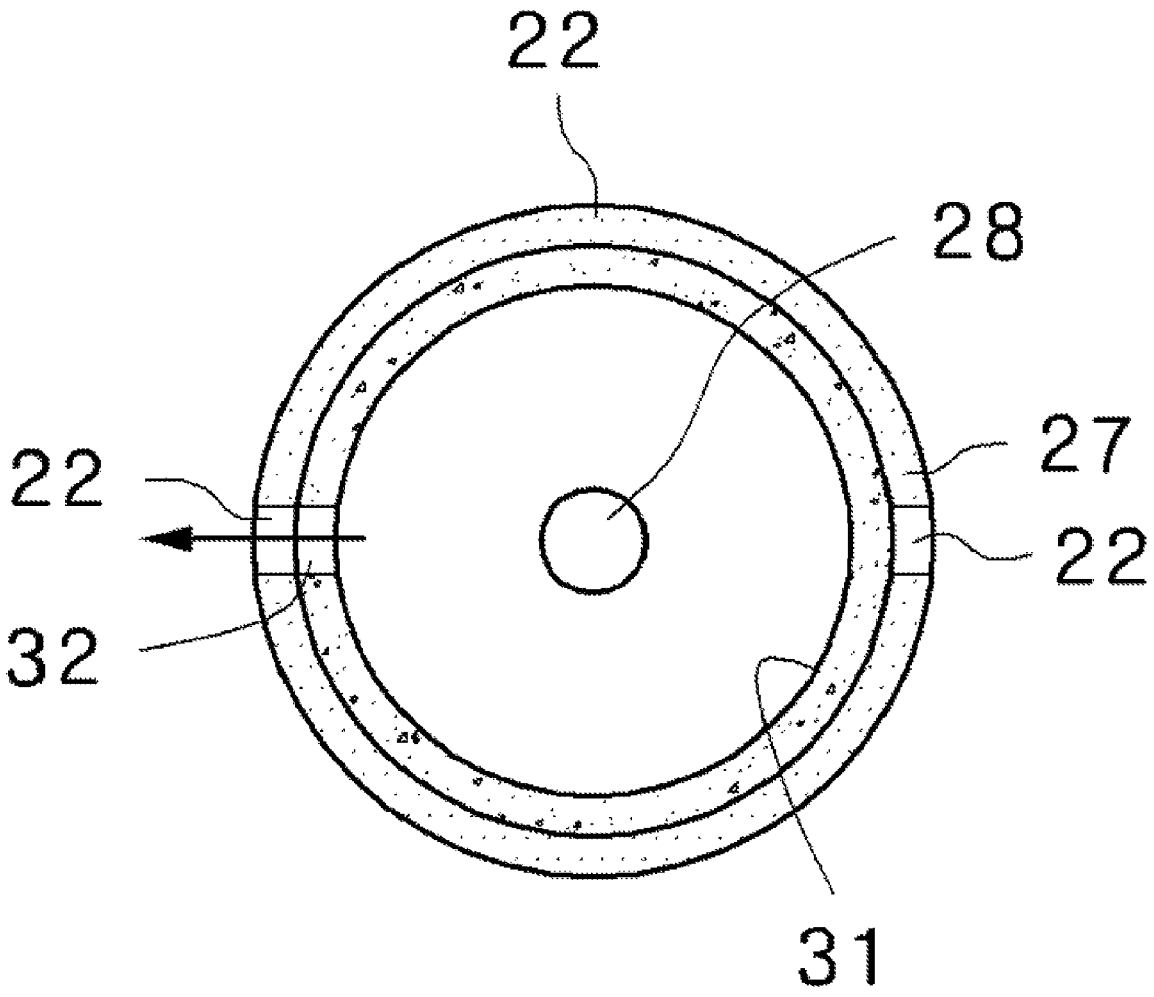

FIG. 9*a* and FIG. 9*b* show a second embodiment of the present invention, that is a diagram showing the open state of the damper. FIG. 9*a* is a perspective view of the dual venturi and FIG. 9*b* is a sectional view showing the positional relationship between the secondary gas inlet and the secondary gas outlets of the damper part.

As shown in the perspective view of FIG. 9*a*, when the damper part (20) is opened, the positional relationship between the tubular part (40) and the damper part (20) is the state in which the upper and lower passageways of the tubular part (40) are opened substantially by the damper part (20), thus the entire passageway becomes the air passageway (secondary air passageway). That is, the damper part (20) is placed perpendicularly to the horizontal plane at the closed state, in other words perpendicularly to the cross-sectional direction of the tubular part (40). Here, as shown in FIG. 9*a*, the primary gas (51) flows through the primary gas inlet (45) and the secondary gas inlet-side secondary gas outlet (32) is also opened to let the secondary gas flow out.

Referring to FIG. 9*b*, the secondary gas inlet-side secondary gas outlet (32) and the damper part-side secondary gas outlet (22) formed on the damper part-side second hole (27) correspond to each other and are therefore connected.

In this embodiment, the secondary gas inlet-side secondary gas outlet (32) is only formed on one side via the circumference diameter such that only one lateral surface (for instance, the upper direction-side surface of the upper and lower directions of the tubular part (40)) of the damper part (20) releases secondary gas. However, for instance, the secondary gas inlet-side secondary gas outlet (32) can also be installed on the opposite side (that is, 180°) of the cylindrical secondary gas inlet (60) wall circumference, to release secondary gas in the upper and lower directions of the damper part (20).

In this embodiment, the primary gas inlet (45) is configured to face the cutout part (26) of the damper part (20), but the angle or the top and bottom heights can be varied to not face the cutout part.

Figure 10A:
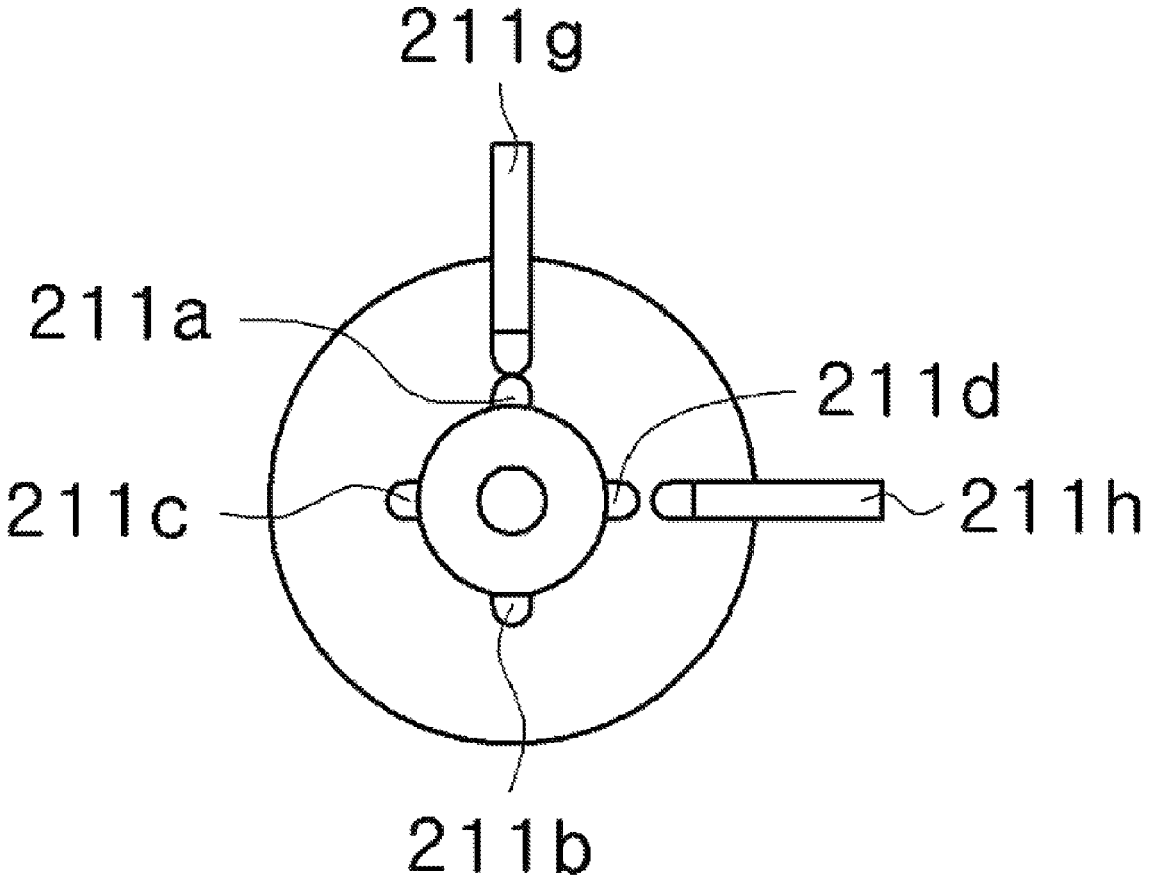
FIG. 10*a* and FIG. 10*b* show the positional relationship between the secondary gas inlet-side secondary gas outlet and the damper part at the limit switch of the driving part.
Figure 10B:
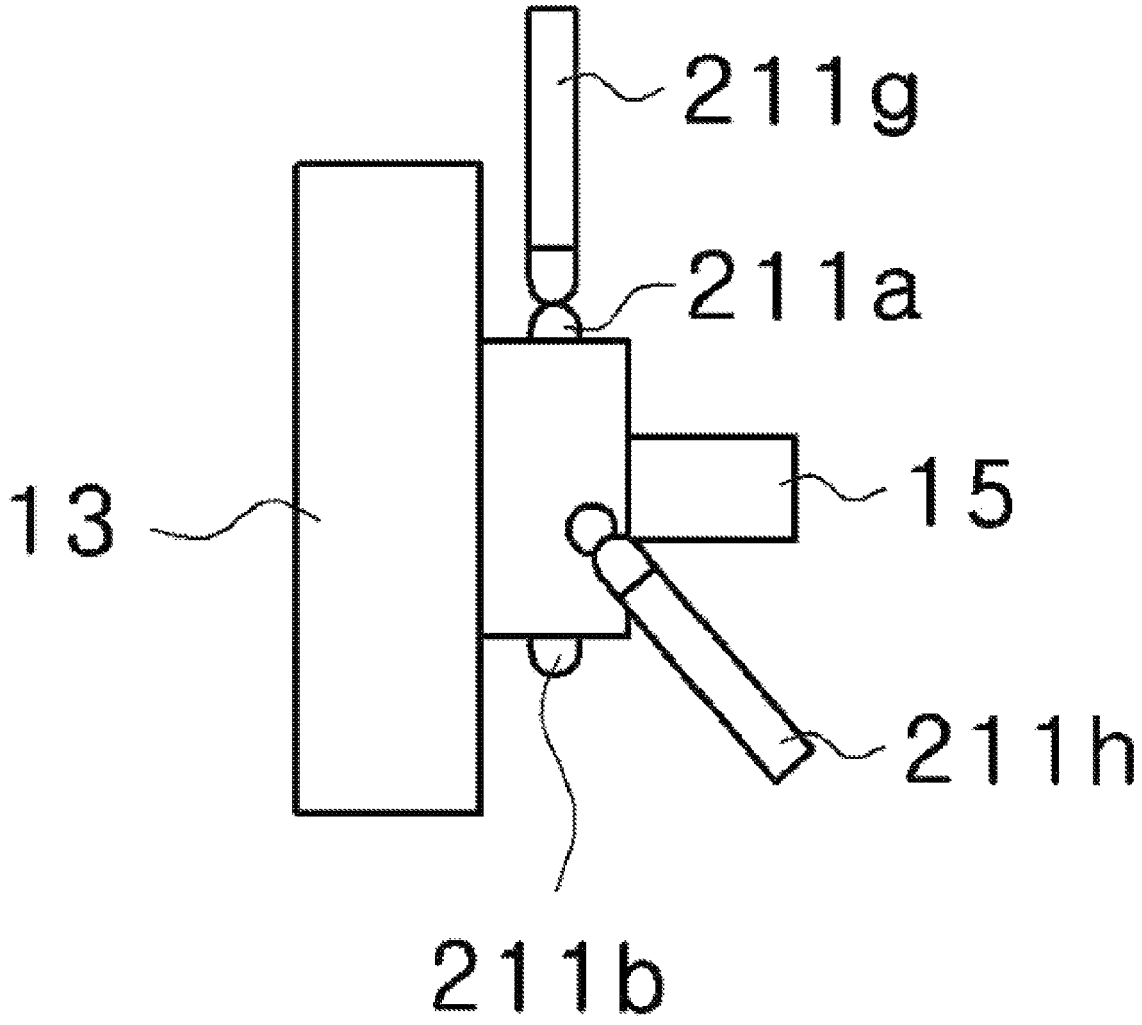
Figure 11:
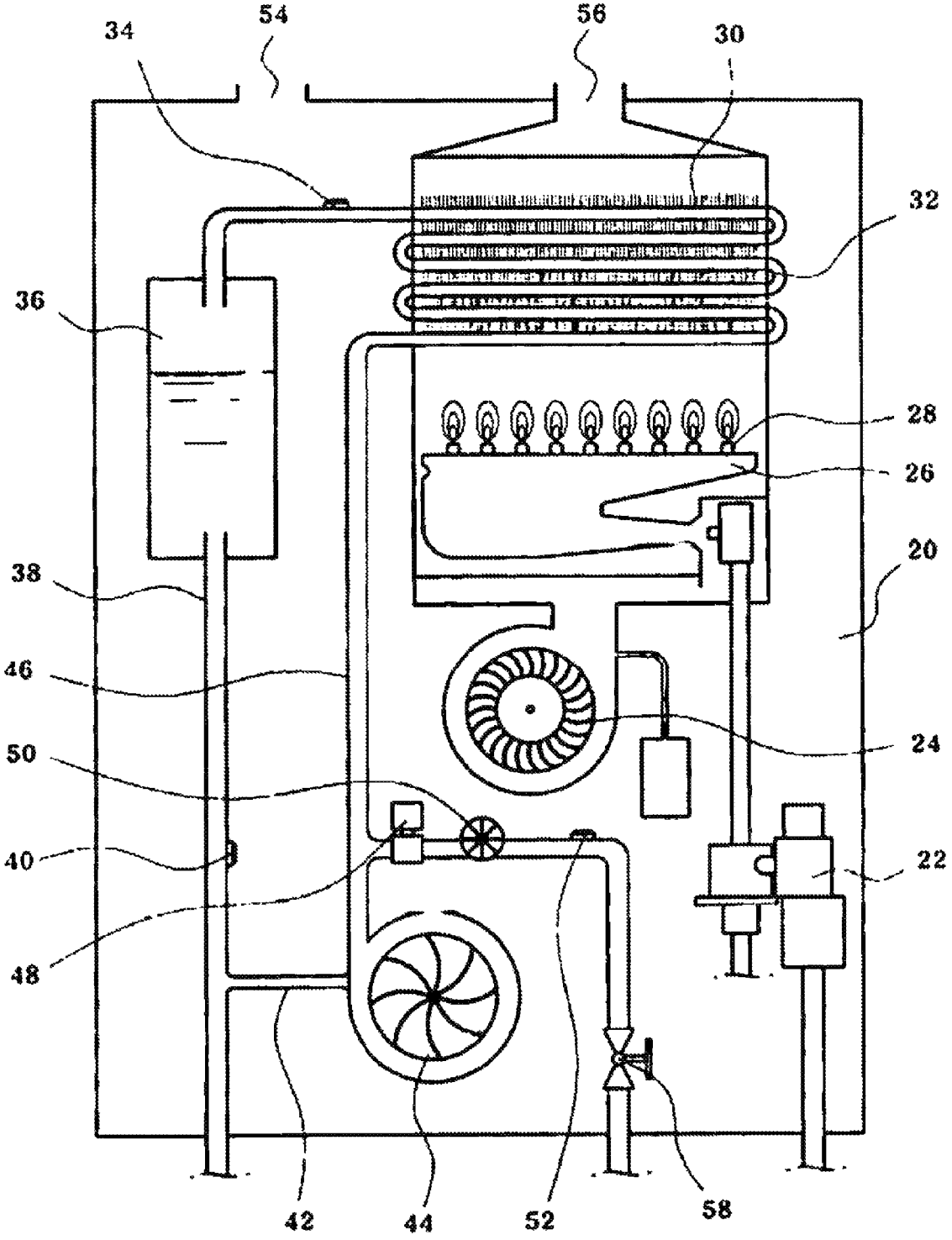
FIG. 11 is a drawing showing prior art.

FIG. 10*a* and FIG. 10*b* show the positional relationship between the secondary gas outlet of the secondary gas inlet and the damper part at the limit switch of the driving part, according to the second embodiment of the present invention. FIG. 10*a* is a planar view of the limit switch and FIG. 10*b* is a lateral view of the limit switch, respectively.

In the limit switch (11) shown in FIG. 10*a*, reference signs 211*a* and 211*b* show the position points of the damper part-side secondary gas outlets, 211*c* and 211*d* respectively show the position points of the secondary gas inlet-side secondary gas outlets, 211*g* shows the damper part-side positional probe, and 211*h* shows the gas inlet-side positional probe, respectively. One of the damper part-side secondary gas outlet position points (211*a*)(211*b*) is positioned at the damper part-side positional probe (211*g*), and in the same manner if one of the secondary gas inlet-side secondary gas outlet position points (211*c*)(211*d*) corresponds to the secondary gas inlet-side positional probe (211*h*), secondary air and secondary gas are blocked, as shown in FIG. 8*c*. That is, it shows the state in which the damper part (20) is at the horizontal position.

Further, on the contrary, if one of the secondary gas inlet-side secondary gas outlet position points (211*c*)(211*d*) corresponds to the damper part-side positional probe (211*g*), and at the same time one of the damper part-side secondary gas outlet position points (211*a*)(211*b*) is positioned at the secondary gas inlet-side positional probe (211*h*), the secondary air and secondary gas are opened to flow through the tubular part (40), as shown in FIG. 9*b*. That is, this shows the state in which the damper part (20) is vertically positioned.

Referring to FIG. 10*b*, a synchronous motor is used as the motor (13) included in the driving part (10) and the rotational shaft (15) of the direct motor (13) can be connected to the damper part-side first hole (23). Thus, components necessary for the AC motor in the prior art such as a wire, or return spring can be removed, allowing the dual venturi of the present invention to be more simplified compared to the prior art.

The above description defines a preferred embodiment of the present invention but is not limited thereto, and various modifications and other similar embodiments are possible by the skilled person in the art. For instance, the combination of the limit switch sets the secondary gas open state as when the damper part-side probe and the secondary gas inlet-side probe positions are against each secondary gas outlet positions. However, the opposite setting may be used as long as practically identical results are indicated. Further, the position of the primary gas inlet is set to face the cutout part of the damper part in the above embodiment, however, this may be varied according to the rotation angle and top and bottom positions of the tubular part. Thus, various modifications and embodiments that can be clearly expected are also within the scope of the present invention.

REFERENCE SIGNS

10: Driving Part, 11: Limit Switch, 11*a*: Damper Part-Side Secondary Gas Outlet Position Point
11*b*: Damper Part-Side Secondary Gas Outlet Position Point,
11*c*: Gas Inlet-Side Secondary Gas Outlet Position Point,
11*d*: Gas Inlet-Side Secondary Gas Outlet Position Point, 11*g*: Damper Part-Side Positional Probe,
11*h*: Gas Inlet-Side Positional Probe, 15: Rotational Shaft of the Motor, 20: Damper Part,
21: Central Passageway, 22: Damper Part-Side Secondary Gas Outlet, 23: Damper Part-Side First Hole,
24: Damper Part-Side Primary Gas Outlet, 26: Cutout Part, 27: Damper Part-Side Second Hole,
28: Damper Part-Side Sealing Hole, 29: Body Part, 30: Gas Inlet Part,
32: Gas Inlet-Side Secondary Gas Outlet, 33: Gas Inlet-Side Primary Gas Outlet,
40: Tubular Part, 41: Tubular Part-Side First Hole, 42: Tubular Part-Side Second Hole,
45: Primary Gas Inlet, 51: Primary Gas, 52: Secondary Gas,
60: Secondary Gas Inlet

The invention claimed is:

1. A dual venturi comprising, a tubular part, as a circular duct through which air and gas pass through, having a primary gas inlet;

a damper part comprising:

a body part located in the tubular part for opening/closing a secondary air flow by rotating in horizontal plane and vertical plane directions, the horizontal plane direction being a cross-sectional direction of the tubular part and the vertical plane direction being perpendicular to the horizontal plane, a cutout part which is a removed portion of the body part, becoming a primary gas passageway in an axial direction of the tubular part via a passageway formed together with an inner surface of the tubular part when the body part is placed in the horizontal plane direction, and a damper part-side secondary gas outlet;

a driving part, connected to a left lateral surface of the damper part via a rotational shaft, for rotationally driving the damper part in the horizontal and vertical planes; and a secondary gas inlet for introducing a secondary gas into the tubular part via the damper part through a gas inlet-side secondary gas outlet, which connects selectively to the damper part-side secondary gas outlet on the basis of a rotational position of the damper part, wherein the secondary gas inlet is cylindrically shaped, and is inserted into a right lateral surface of the damper part, wherein a central axis of the rotational shaft is coaxial with a central axis of the secondary gas inlet such that the body part is rotated about the secondary gas inlet by the driving part, and wherein the primary gas inlet faces the cutout part when the body part is placed in the horizontal direction.

2. The dual venturi as claimed in claim 1, wherein the driving part comprises a synchronous motor, and wherein the rotational shaft of the driving part is a rotational shaft of the synchronous motor.

3. The dual venturi as claimed in claim 1, wherein the gas inlet-side secondary gas outlet is connected to the damper part-side secondary gas outlet when the body part is vertically positioned.

4. The dual venturi as claimed in claim 1, wherein the driving part comprises a limit switch indicating the vertical position and horizontal position of the damper part.

5. The dual venturi as claimed in claim 1, wherein the tubular part includes an upper portion, a central portion, and a bottom portion, and wherein the central portion has a relatively small diameter such that air passing through the central portion is accelerated and creates a relative vacuum through a venturi effect.

6. The dual venturi as claimed in claim 1, wherein the damper part-side secondary gas outlet is formed on an outer surface of the body part, such that the damper part-side secondary gas outlet faces upwardly when the damper part is rotated into the horizontal plane.

7. The dual venturi as claimed in claim 1, wherein the damper part-side secondary gas outlet is formed on an outer surface of the body part, such that the damper part-side secondary gas outlet faces both upwardly and downwardly when the damper part is rotated into the horizontal plane.

8. The dual venturi as claimed in claim 6, wherein only one gas inlet-side secondary gas outlet is formed on the gas inlet part, and wherein the damper part-side secondary gas outlet connects to the only one gas inlet side secondary gas outlet when the damper part is rotated into the vertical plane.

9. The dual venturi as claimed in claim 6, wherein two inlet-side secondary gas outlets are formed on the gas inlet part, and wherein the damper part-side secondary gas outlet connects to both of the two inlet-side secondary gas outlets when the damper part is rotated into the vertical plane.

* * * * *